US005519982A

United States Patent [19]

Herber et al.

[11] Patent Number: 5,519,982

[45] Date of Patent: May 28, 1996

[54] POUCH HAVING EASY OPENING AND RECLOSING CHARACTERISTICS AND METHOD AND APPARATUS FOR PRODUCTION THEREOF

[75] Inventors: Terrence W. Herber, Grayslake; Mark J. Yunker, Buffalo Grove; Kyle S. Nakazawa, Des Plaines; Farrad Sadeghzadeth, Chicago; Wayne H. Rothschild, Wheeling, all of Ill.

[73] Assignee: Kraft Foods, Inc., Northfield, Ill.

[21] Appl. No.: 422,636

[22] Filed: Apr. 14, 1995

Related U.S. Application Data

[63] Continuation of Ser. No. 6,374, Jan. 19, 1993, abandoned, which is a continuation-in-part of Ser. No. 893,855, Jun. 5, 1992, abandoned, which is a continuation-in-part of Ser. No. 708,914, May 31, 1991, abandoned.

[51] Int. Cl.[6] ..... B65B 61/18

[52] U.S. Cl. ..... 53/412; 53/133.3; 53/133.4; 53/133.8; 53/139.2

[58] Field of Search ..... 53/133.4, 139.2, 53/450, 553, 412, 133.8, 133.6, 389.3, 133.3; 156/66; 493/213, 233, 238; 83/660, 695, 623

[56] References Cited

U.S. PATENT DOCUMENTS

| | | | |
|---|---|---|---|
| 3,589,913 | 6/1971 | Rosenberg | 53/552 X |
| 3,784,432 | 1/1974 | Noguchi . | |
| 3,789,888 | 2/1974 | James et al. . | |
| 3,834,113 | 9/1974 | Howe et al. . | |
| 4,358,979 | 11/1982 | Kurzbuch | 83/660 X |
| 4,372,793 | 2/1983 | Herz . | |
| 4,561,109 | 12/1985 | Herrington . | |
| 4,589,145 | 5/1986 | Van Erden et al. . | |
| 4,617,683 | 10/1986 | Christoff . | |
| 4,620,467 | 11/1986 | Margraf et al. | 83/660 X |
| 4,637,060 | 1/1987 | Ausnit . | |
| 4,651,504 | 3/1987 | Bentsen . | |
| 4,665,552 | 5/1987 | Lems et al. . | |
| 4,676,051 | 6/1987 | Hoskinson et al. . | |
| 4,682,976 | 7/1987 | Martin et al. | 53/133.8 |
| 4,709,533 | 12/1987 | Ausnit . | |
| 4,744,674 | 5/1988 | Nocek . | |
| 4,745,731 | 5/1988 | Talbott et al. . | |
| 4,779,400 | 10/1988 | Hoskinson et al. . | |
| 4,782,951 | 11/1988 | Griesbach et al. . | |

(List continued on next page.)

FOREIGN PATENT DOCUMENTS

| | | |
|---|---|---|
| 0275396 | 7/1988 | European Pat. Off. . |
| 0395362 | 10/1990 | European Pat. Off. . |
| 0398731 | 11/1990 | European Pat. Off. . |
| 0456277A3 | 11/1991 | European Pat. Off. . |
| 0457617A1 | 11/1991 | European Pat. Off. . |
| 0513550A3 | 11/1992 | European Pat. Off. . |
| 2586650 | 3/1987 | France . |

*Primary Examiner*—Linda Johnson
*Attorney, Agent, or Firm*—Fitch, Even, Tabin & Flannery

[57] ABSTRACT

A pouch for containing a food product such as shredded cheese, and a novel method and apparatus for forming, filling and sealing the pouch. The method involves providing one or more webs of material to define a pair of walls for the pouch, orienting the web material so that the walls are substantially vertical, with the web having a horizontal longitudinal axis; providing interengageable strips of reclosable fastener material along the web adjacent the lower edges of the walls; forming vertical side seals; filling the pouches through their open bottoms while in inverted orientation; and sealing the bottoms of the pouches. Each of the strips of reclosable fastener material has one or more fastener members thereon. A peelable seal is provided between the product contained in the interior of the pouch and the reclosable fastener members. The peelable seal is preferably formed on the fastener strip material. The peelable seal is sealed prior to filling of the pouches so that product cannot contact the fastener members, and the fastener members are outside of the hermetic seal area. The pouch is preferably provided with a hole above the fastener members to receive a display hanger, and has a line of perforation above the fastener members and above the hole to facilitate removal of the upper portion of the pouch.

27 Claims, 14 Drawing Sheets

U.S. PATENT DOCUMENTS 4,786,190 11/1988 Van Erden et al. .
4,812,074 3/1989 Ausnit et al. .
4,832,505 5/1989 Ausnit et al. .
4,835,835 6/1989 Gould .
4,846,586 7/1989 Bruno .
4,874,257 10/1989 Inagaki .
4,876,842 10/1989 Ausnit .
4,894,975 1/1990 Ausnit .
4,909,017 3/1990 McMahon et al. .
4,923,309 5/1990 VanErden .
4,925,316 5/1990 Van Erden et al. .
4,925,318 5/1990 Sorenson .
4,945,714 8/1990 Bodolay et al. .
4,957,571 9/1990 Cipolla .
5,036,643 8/1991 Bodolay .
5,036,645 8/1991 Schwarz .
5,047,002 9/1991 Zieke et al. .
5,059,036 10/1991 Richison et al. ..... 383/61
5,107,658 4/1992 Hustad et al. .

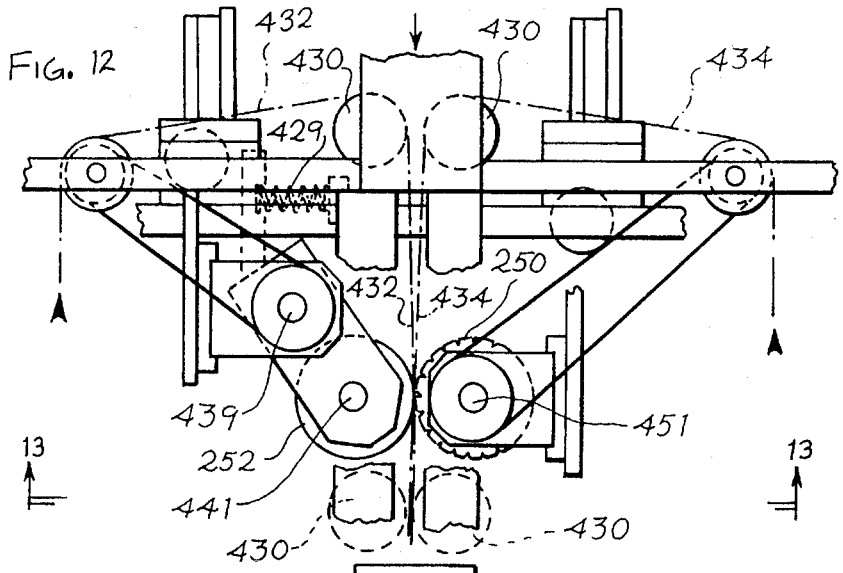
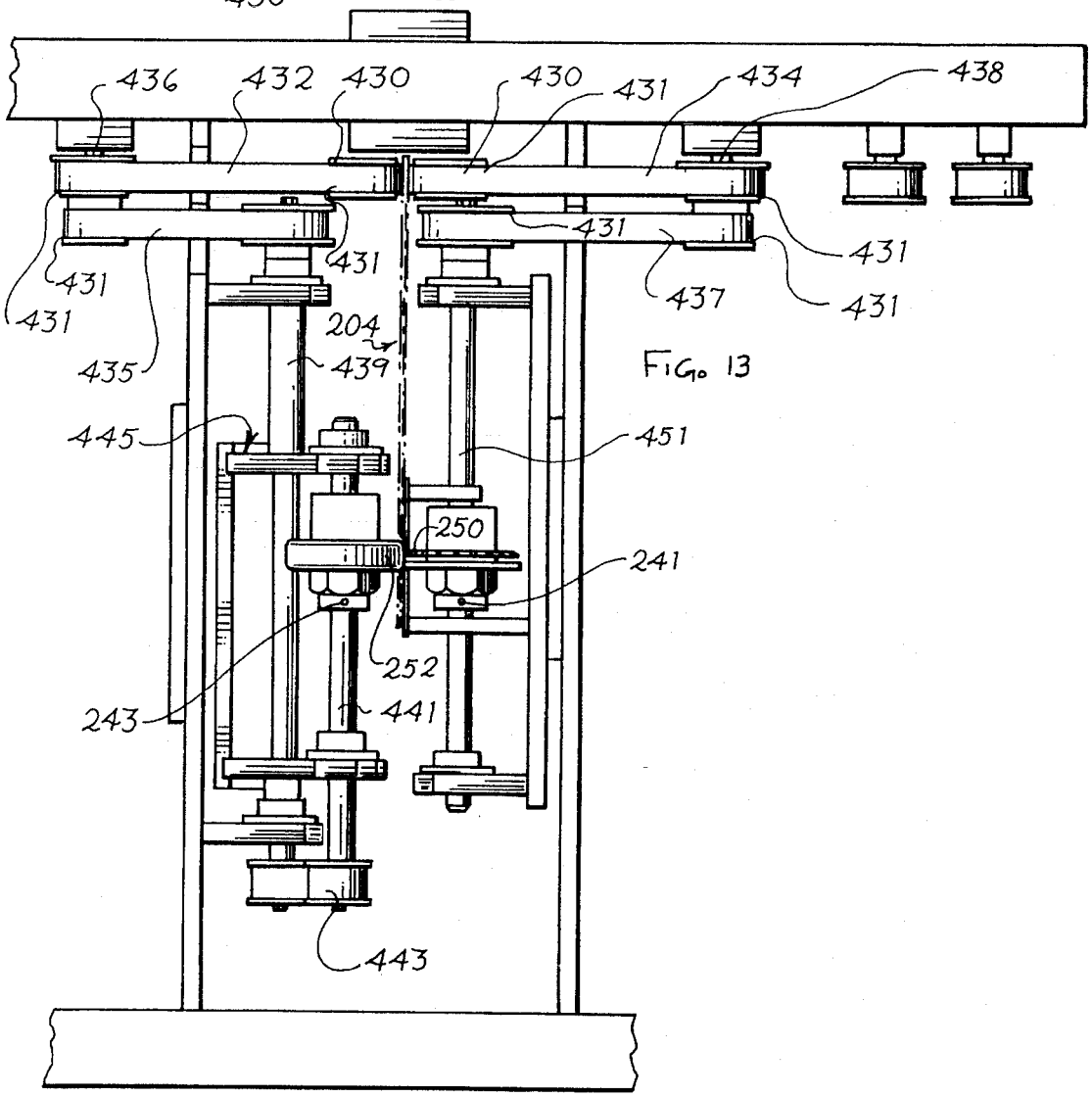
FIG. 13

POUCH HAVING EASY OPENING AND RECLOSING CHARACTERISTICS AND METHOD AND APPARATUS FOR PRODUCTION THEREOF

CROSS-REFERENCE TO RELATED APPLICATIONS

This application is a continuation of application Ser. No. 08/006,374, filed Jan. 19, 1993, now abandoned, which is a continuation-in part of U.S. patent application Ser. No. 893,855, filed Jun. 5, 1992 and entitled "Recloseable Pouch and Method and Apparatus for Forming, Filling, and Sealing", now abandoned, which is a continuation-in-part of U.S. patent application Ser. No. 708,914, filed May 31, 1991 and entitled "Recloseable Pouch and Method and Apparatus for Forming, Filling and Sealing" now abandoned, both of which are incorporated by reference as if fully reproduced herein.

FIELD OF THE INVENTION

The invention relates generally to packaging for food products, and more particularly to easy opening and reclosable pouches and methods and apparatus for forming, filling and sealing such pouches.

BACKGROUND OF THE INVENTION

It is well known in the art that, for certain food products, efficiency in packaging and acceptable shelf life can be obtained by hermetically sealing the product in a package in a form/fill/seal (FFS) operation.

In providing a commercially viable package through FFS operations, several considerations must be addressed. One consideration is that the package must be capable of being opened by the consumer without undue difficulty. Another consideration is that the package must be economical to produce, and should be capable of being formed, filled and sealed at relatively high rates. It is also desirable that the package be durable so as to withstand the stresses of the FFS operation and subsequent shipping and handling without damage and without deterioration of appearance.

In recent years, there has been increased demand for zippers or other means to provide reclosability. One particular package configuration that has been used commercially in recent years has a generally rectangular configuration with a reclosable zipper extending within a fold along one edge, as illustrated in, e.g., U.S. Pat. No. 4,589,145. To open the package, the package material may be slit along the folded edge with a knife, scissors, or the like to gain access to the zipper, and the zipper is then opened to provide access to the product. Where each package is to contain a stack of sliced product or a relatively large item such as a block of cheese, the stack or block may be placed on a horizontally-oriented web and the web can be wrapped around the item to form the package as described in the above-referenced U.S. Pat. No. 4,589,145.

When handling products comprised of numerous small pieces such as shredded cheese, cereal, etc., it is generally desirable to have the package partly formed into a pouch which is open at one end, or along one side, with the pouch oriented so that the open end or side is at the top of the partially-formed pouch, and to dispense product into the partially-formed pouch through the open top or side.

Vertical FFS operations such as that described in U.S. Pat. No. 4,874,257 represent one approach to addressing the aforementioned considerations in packaging food products comprised of numerous small pieces. In the method of U.S. Pat. No. 4,874,257, the zipper is disposed vertically along one side of the package being formed, and the pouch is filled by gravity-induced flow of product downward from a filling spout.

Another approach is illustrated by U.S. Pat. No. 4,945,714, in which the pouches travel horizontally as they are formed, filled and sealed. In U.S. Pat. No. 4,945,714, the pouch is formed in an inverted orientation from a single web which has a fold at its lower end and a zipper within the fold. Two potential problems with this approach are that penetration of product into the zipper may occur, and that if the upper end of the pouch is perforated to facilitate opening, or punched to receive a display hanger, loss of hermeticity would result.

One problem that must be addressed in any zipper-equipped package such as those mentioned above is that, where the ends of the zippers extend into seal areas, difficulty may be encountered in providing hermeticity at high throughput rates, due to the increased thickness of the seal area at the ends of the zipper.

As mentioned above, it may be desirable to provide a line of perforation across the pouch adjacent the folded end thereof to facilitate easy opening of the pouch by tearing along the line of perforation. It is important that the line of perforation be straight and continuous, without significant deviation from linearity and with general uniformity in the size and spacing of the perforations to allow for continuous, easy and uninterrupted tearing along the entire width of the pouch. It is also important that the line of perforation be formed in both the front and rear walls of the pouch, with the perforations in the front wall lining up with the perforations in the rear wall. Furthermore, it is desirable to provide such a line of perforation which does not affect the hermeticity of the pouch.

There is a continuing need for improved packages of the type described above, and for improved FFS operations for such packages which address the aforementioned considerations while avoiding the disadvantages of the prior art discussed above.

SUMMARY OF THE INVENTION

The invention provides a novel pouch for containing food product, and novel methods and apparatus for forming, filling and sealing the pouch in an inverted orientation. The method involves providing a web of material having a centerline to define a pair of walls for the pouch, providing interengageable strips of reclosable fastener material and attaching the strips to the web by first attaching a first one of said strips to the web in its horizontal orientation, folding the web along said centerline to form sidewalls and bring one of the sidewalls adjacent the second strip, and then attaching the second strip to said sidewall, with engaged first and second strips being attached to respective sidewalls adjacent the folded lower end of the web; forming a peelable seal above the closure members of the strips; sealing the sidewalls at the line of perforation; forming vertical side seals; forming a line of perforation across the width of the sidewalls between the folded lower end and the interengaged closure members; partially separating the pouches from one another by vertically slitting the sidewalls; filling the pouches through their open bottoms while in inverted orientation; and sealing the bottoms of the inverted pouches.

In accordance with one aspect of the invention, a line of perforation is provided between the folded lower end of the pouch and the interengageable closure members to provide easy opening of the pouch and easy access to the closure members. The line of perforation is formed by initially bringing together first and second engaging members on either side of the sidewalls to secure a portion of the sidewalls in a stationary position. While the sidewalls are secured in a substantially stationary position, a perforating blade is impacted against that portion of the sidewalls to pierce the sidewalls. The perforating blade has a series of generally equally spaced perforating points along its length which create generally equally spaced perforations in the sidewalls when the sidewalls are pierced by the impacting perforating blade.

In accordance with another aspect of the invention, a hermetic peelable seal is provided between the product contained in the interior of the pouch and the reclosable fastener members, which peelable seal is preferably formed simultaneously with perforation of the sidewalls by the perforating blade.

The peelable seal is preferably formed as a relatively narrow band on the fastener strip material, rather than on the wall material. This provides a saving of material cost as compared with coating the entire interior surface of the pouch walls with materials suitable for formation of a peelable seal. The peelable seal is sealed prior to filling of the pouches so that product cannot contact the fastener members during or after the form, fill, seal operation.

The peelable seal is preferably formed by a pair of reciprocable sealing bars which provide a predetermined sealing pressure to the seal area while transferring heat thereto sufficient to bond the peelable seal strips of opposite closure flanges together. In accordance with the preferred embodiment of the invention, the extension and retraction of the perforating blade is carried out during the interval that the peelable seal forming sealing bars are together effecting the peelable seal. That is, the peelable seal and the perforation line are both formed at the same station at which the web intermittently comes to rest.

The pouch is preferably provided with a hole to receive a display hanger above the fastener members and beneath the line of perforation. Referring to the completed pouch in an upright position, the interengageable fastener members are spaced a short distance beneath the top of the pouch.

Further aspects of the invention are disclosed below and in the accompanying drawings.

BRIEF DESCRIPTION OF THE DRAWINGS

In the drawings, wherein like elements are referenced alike.

Figure 9:
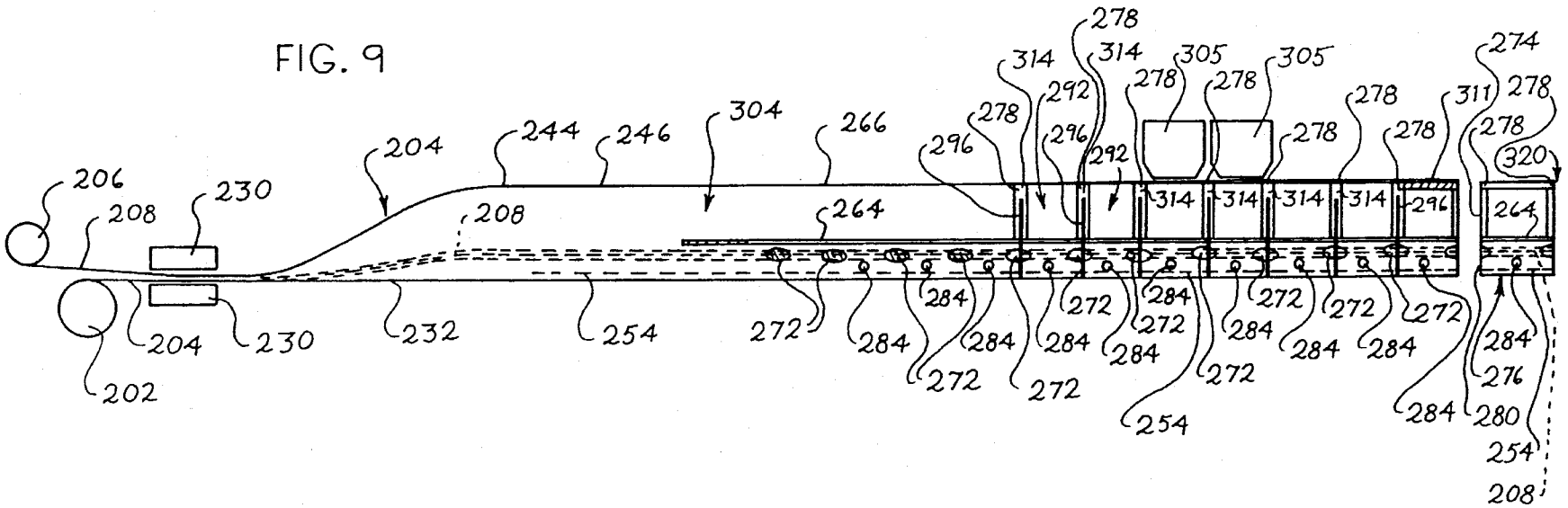

FIG. **8*a*** is a diagrammatical plan view of a further alternative embodiment of apparatus for forming, filling and sealing pouches in accordance with the present invention;

FIG. 9 is an elevational view of the apparatus of FIG. **8*a*;**

Figure 10:
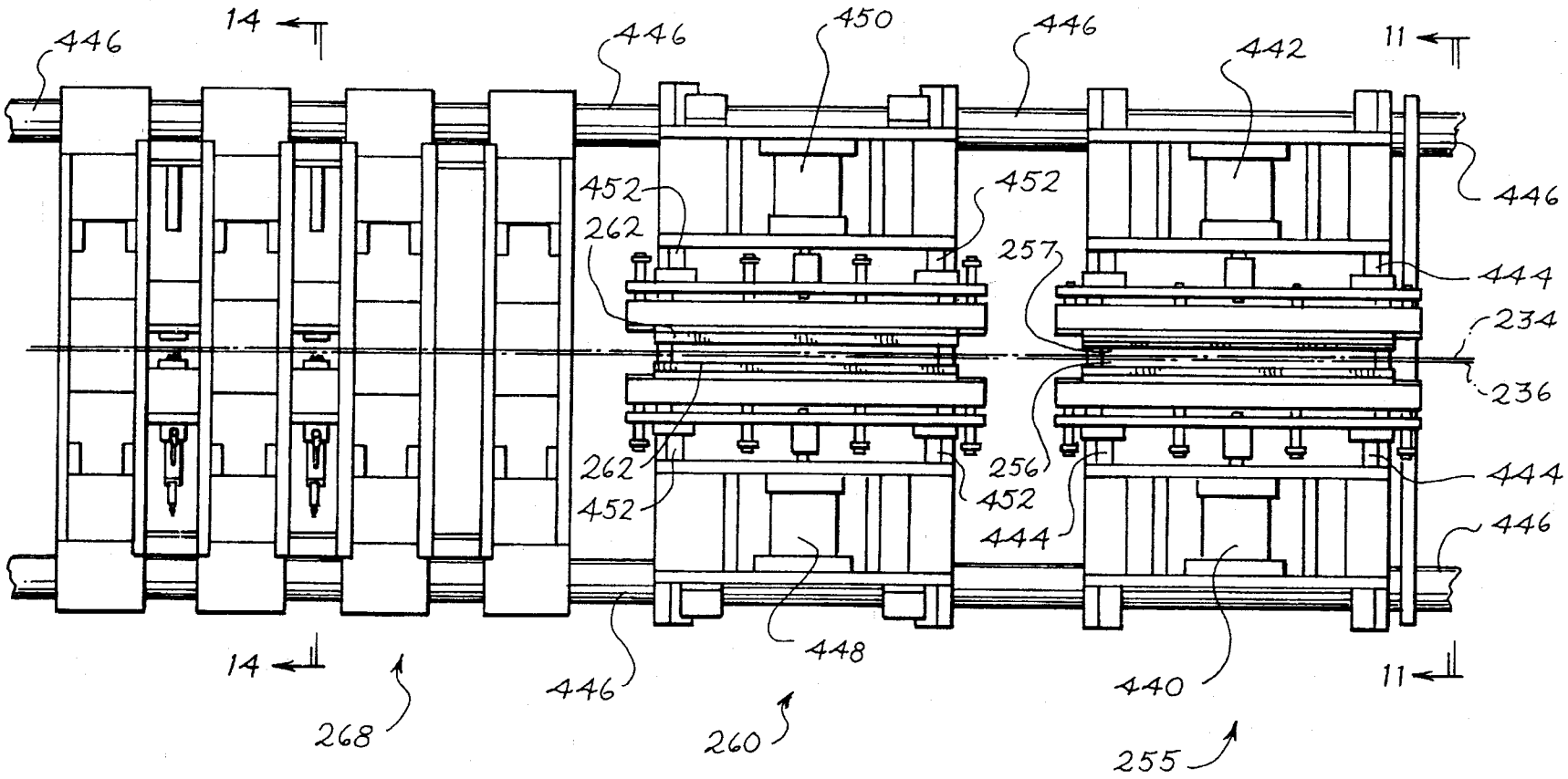

FIG. 10 is a fragmentary plan view of the central portion of the apparatus of FIG. **8*a*;**

Figure 11:
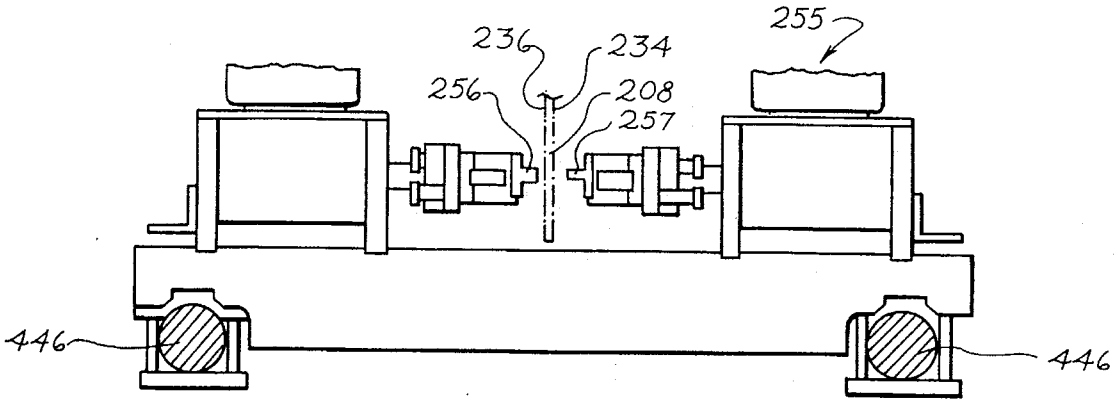

FIG. 11 is a cross-sectional view of the closure strip sealing station taken along line 11—11 of FIG. 10;

FIG. 12 is a plan view of the perforating station of the apparatus of FIG. **8*a*;**

Figure 14:
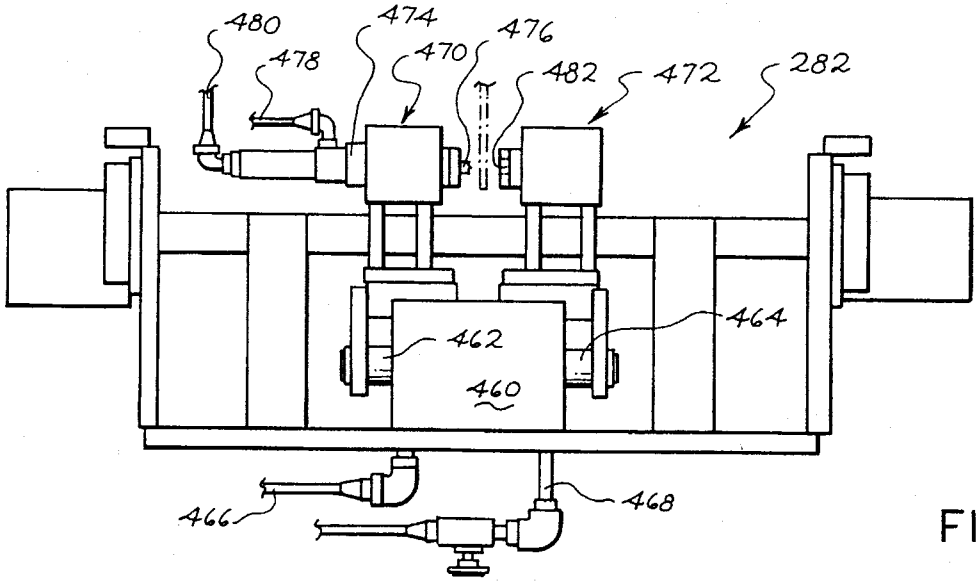
Figure 17:
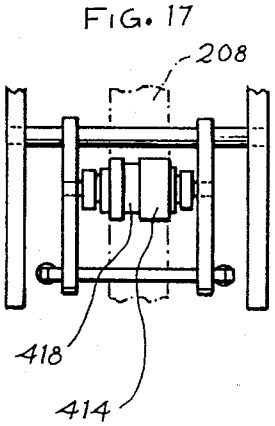
Figure 16:
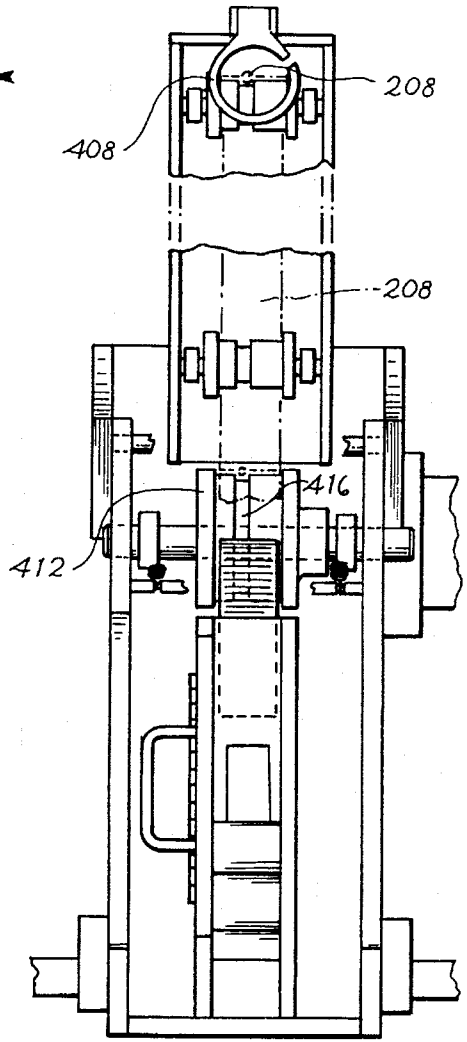
Figure 15:
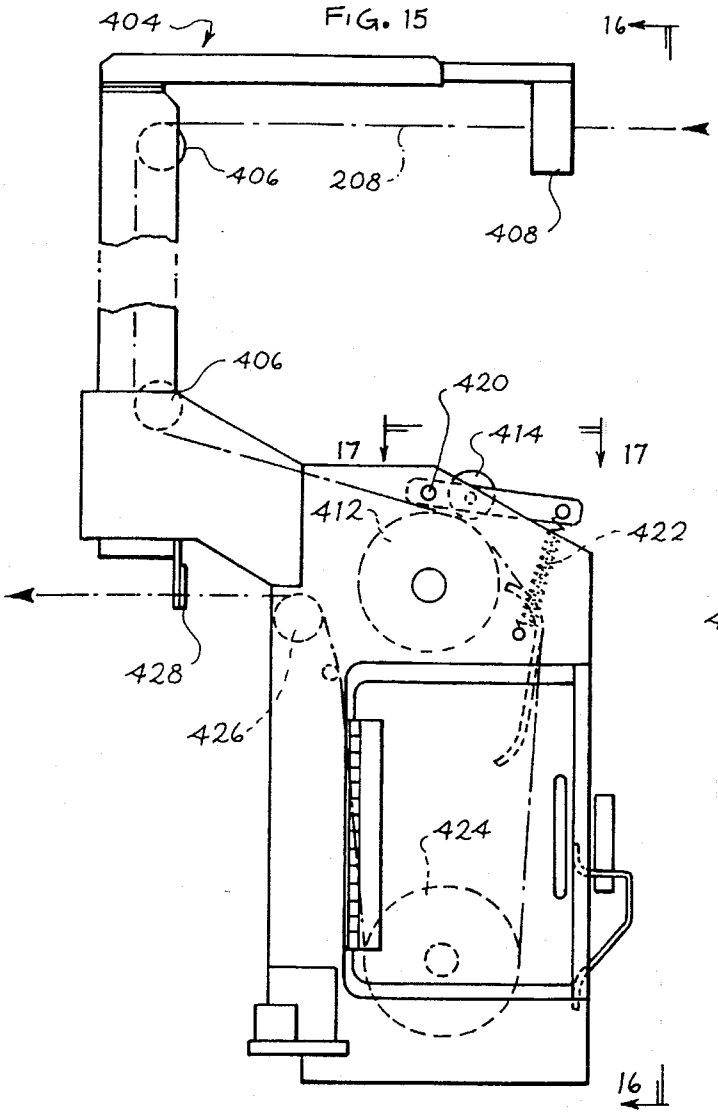
Figure 18:
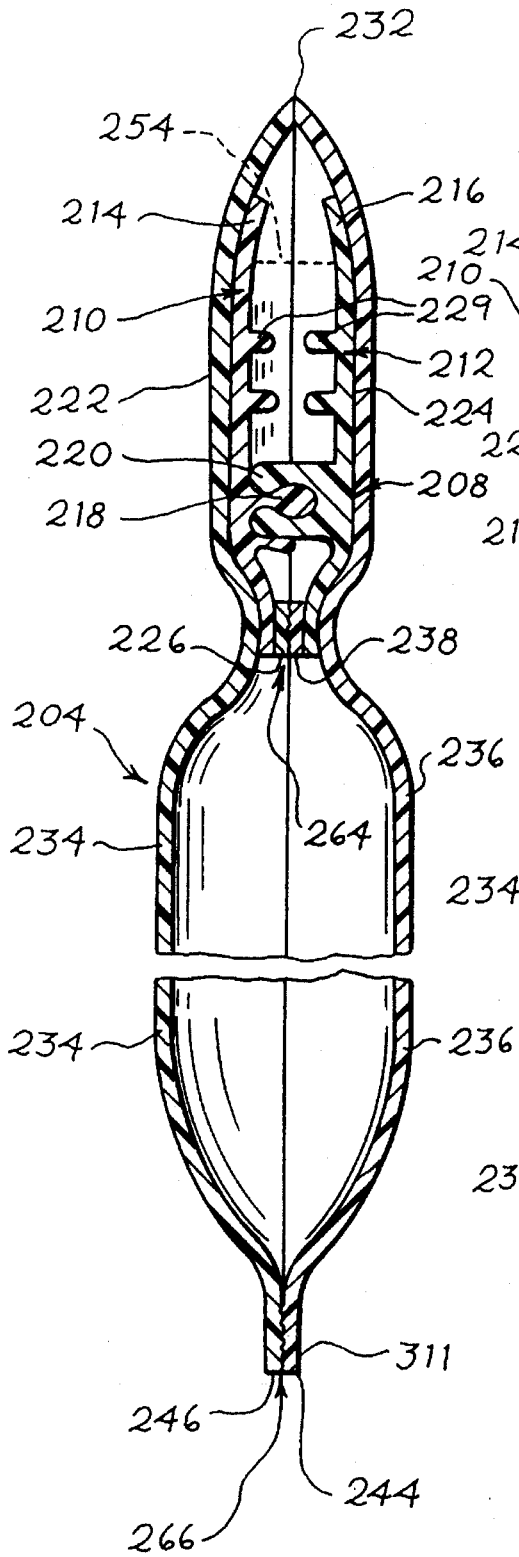
Figure 19:
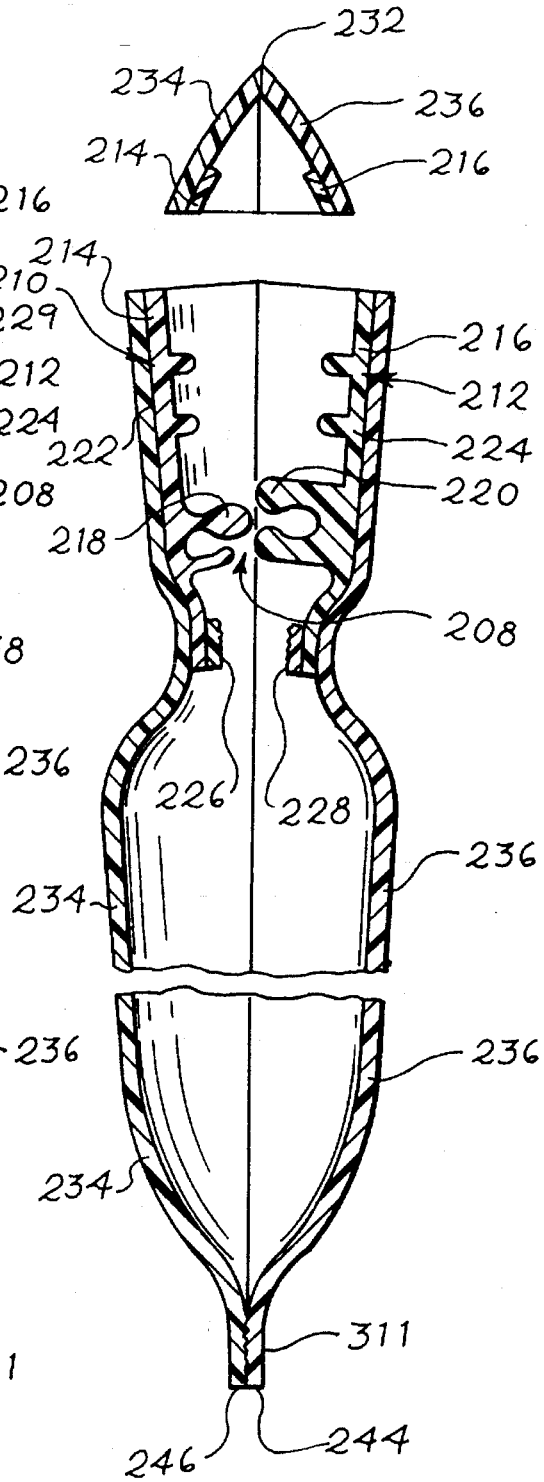
Figure 19A:
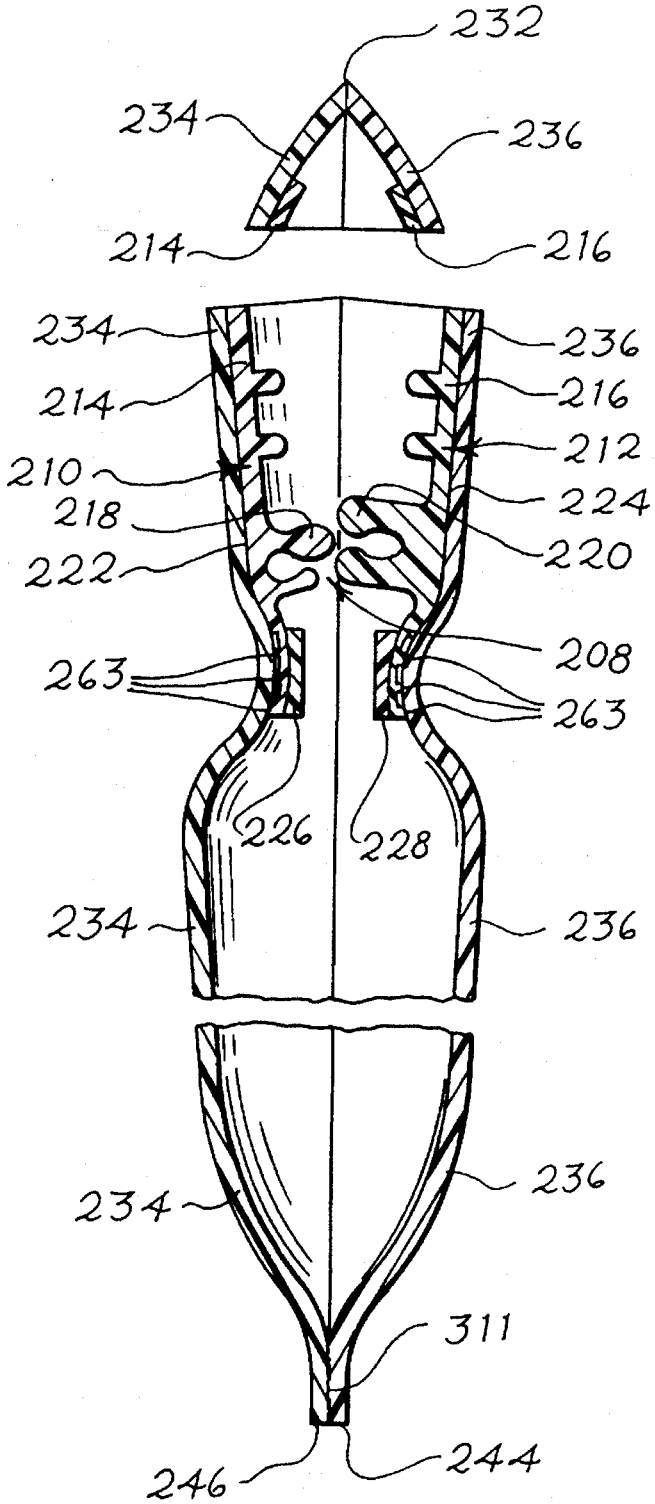
Figure 20:
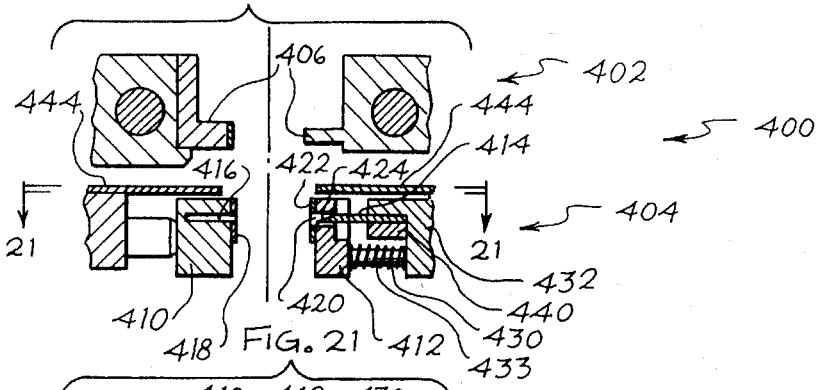
Figure 21:
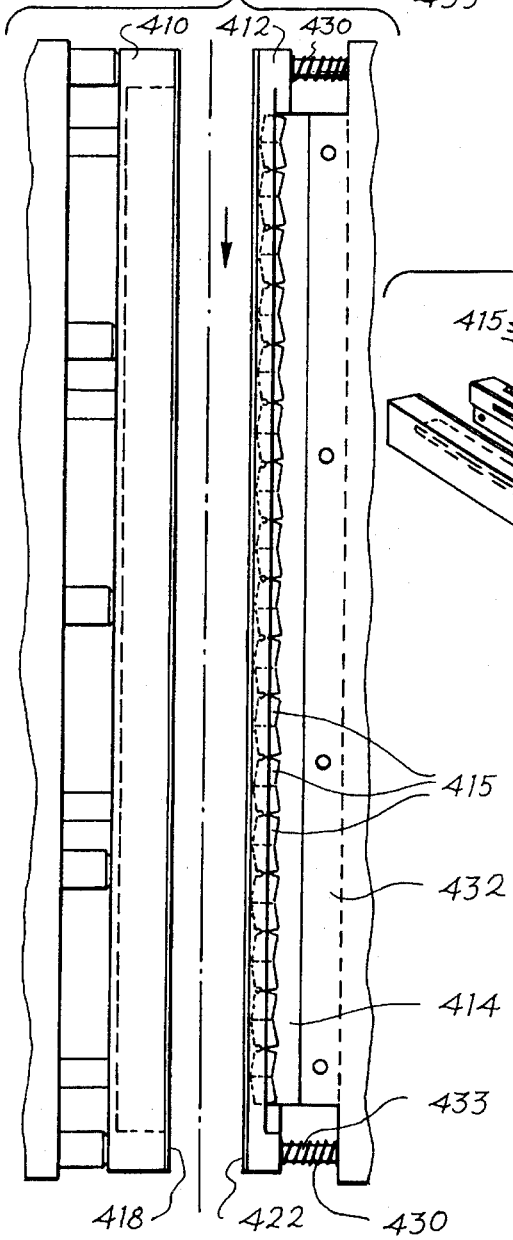
Figure 22:
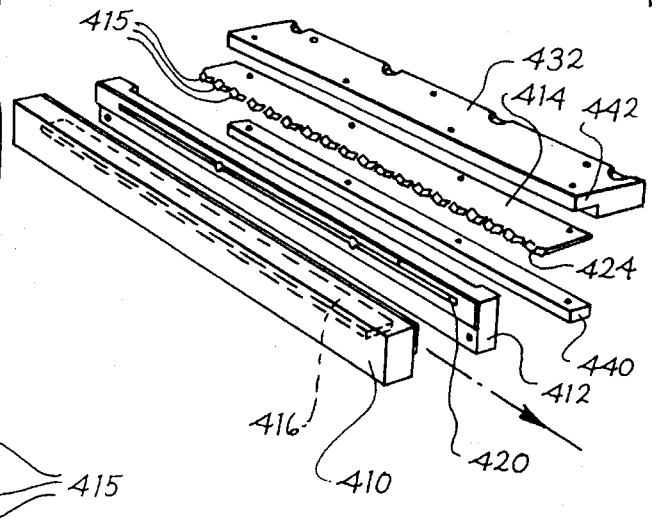
Figure 27:
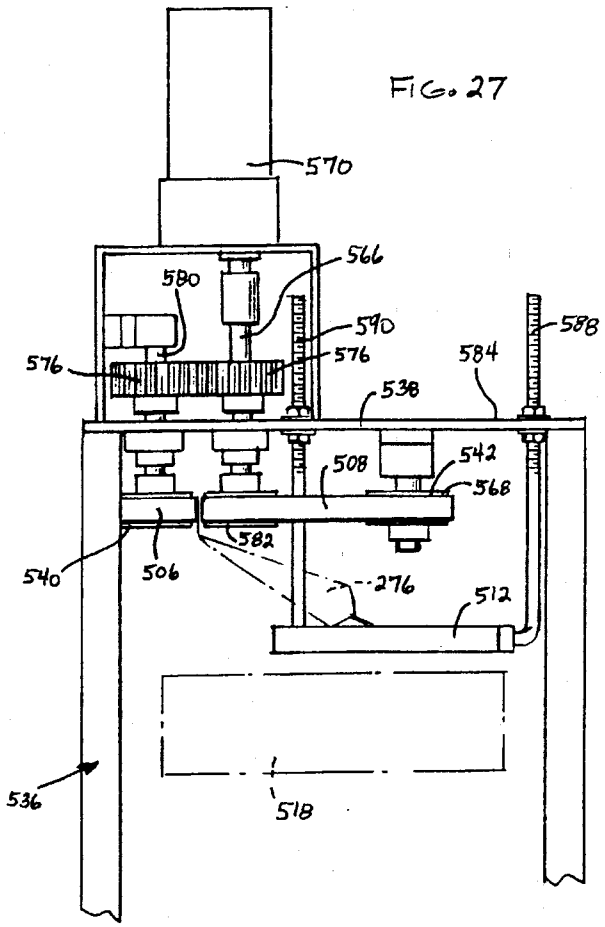
Figure 23:
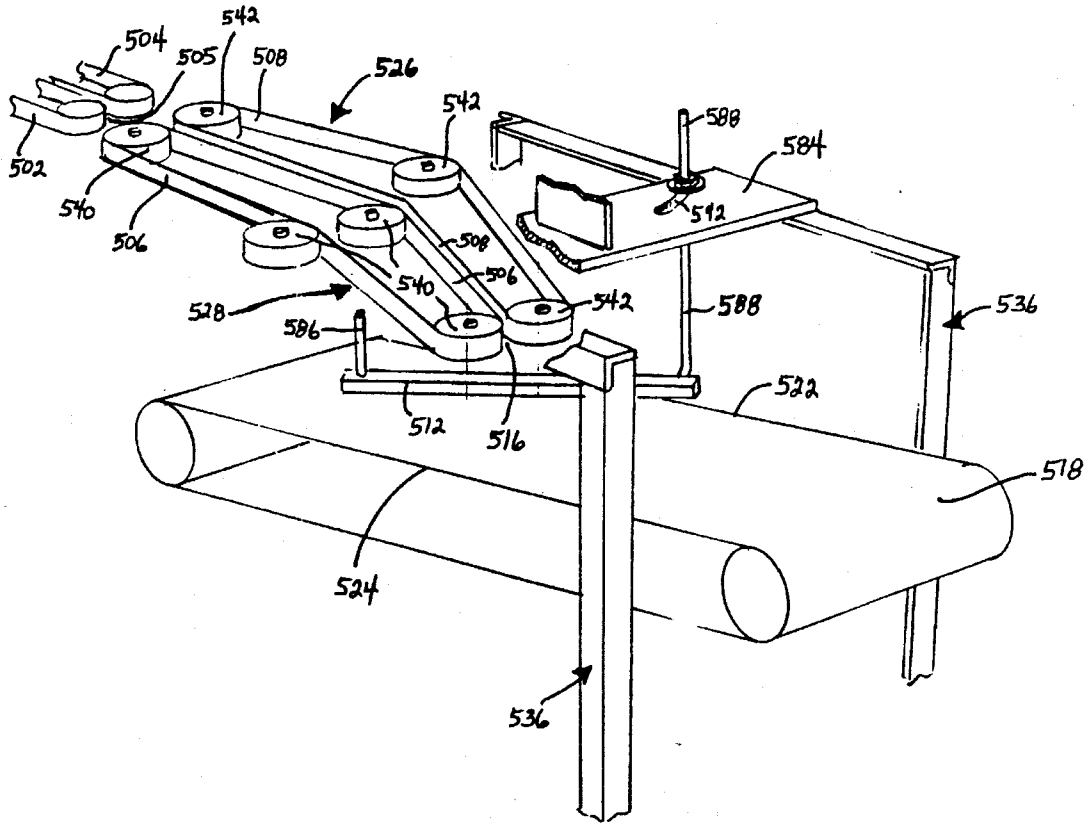
Figure 24:
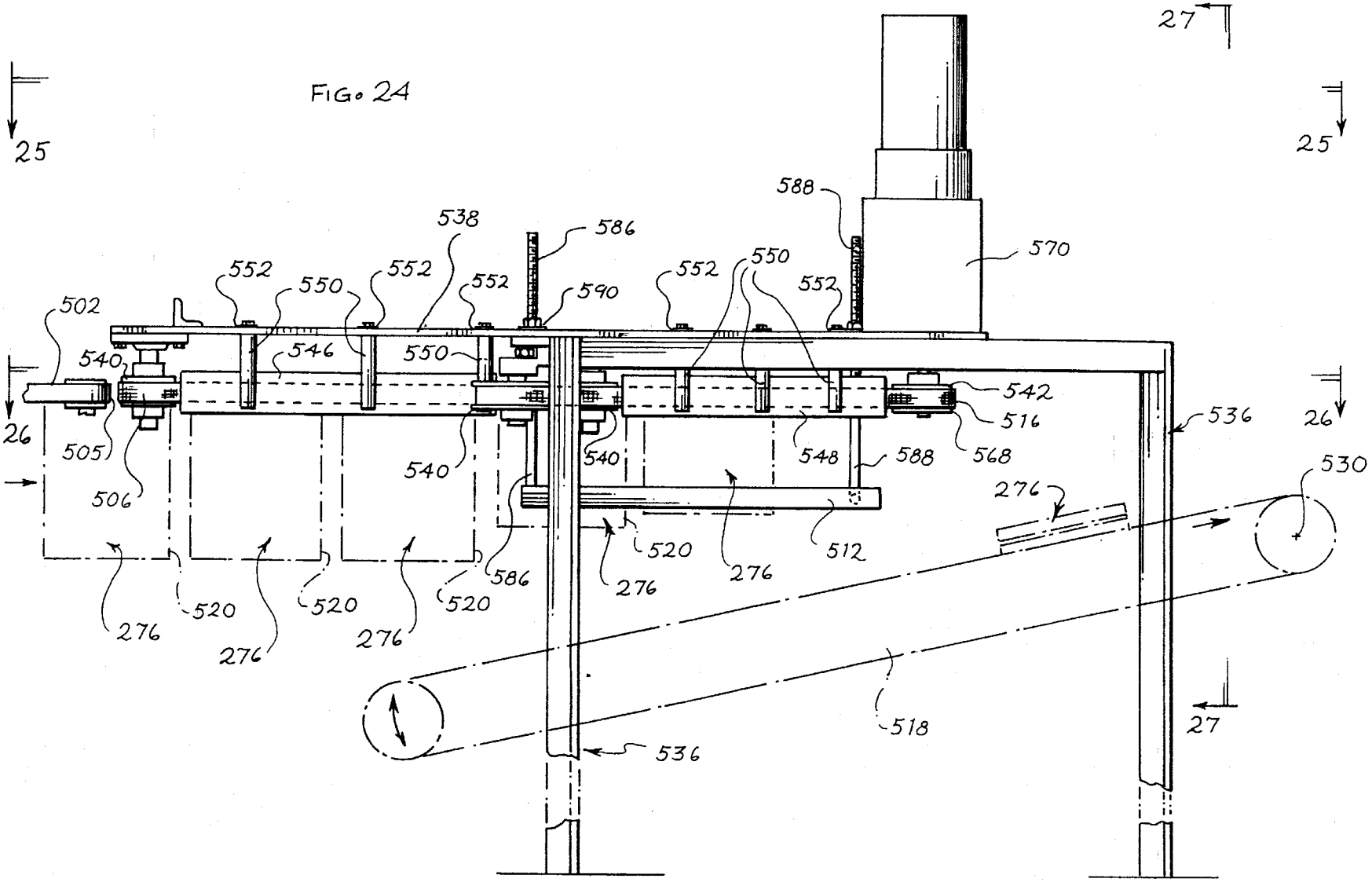
Figure 25:
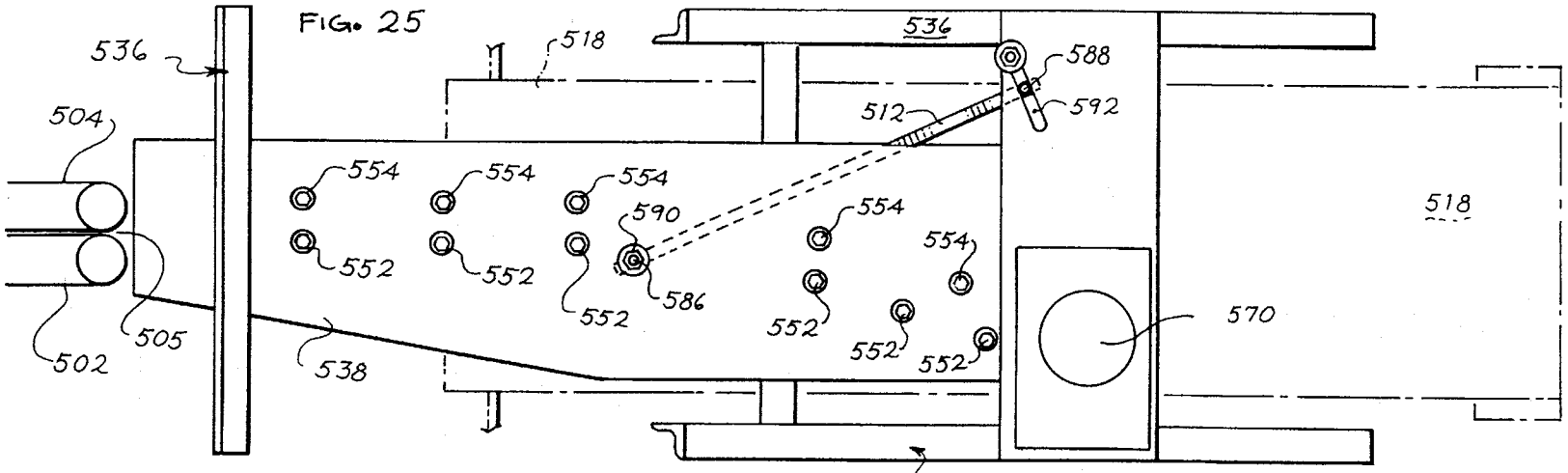
Figure 26:
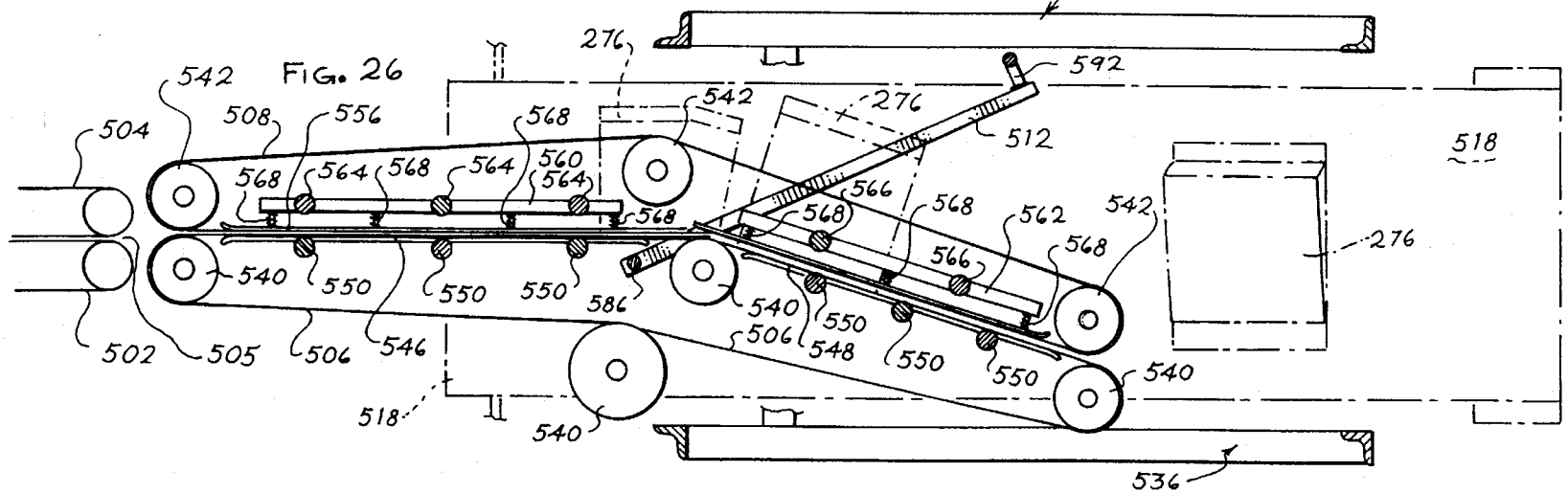

FIG. 13 is an elevational view of the perforating station taken along line 13—13 of FIG. 12;

FIG. 14 is a cross-sectional view of the hole punching mechanism taken along line 14—14 of FIG. 10;

FIG. 15 is a side elevational view of the closure strip unwind unit;

FIG. 16 is an end elevational view of the closure strip unwind unit;

FIG. 17 is a plan view of the pressure roller of the closure strip unwind unit taken along 17—17 of FIG. 15;

FIG. 18 is a sectional view of a pouch in accordance with an alternative embodiment of the invention;

FIG. 19 is a sectional view of the pouch of FIG. 18 showing a removable portion of the pouch torn away to permit access to the interior thereof;

FIG. 19A is a sectional view of an alternative pouch embodiment having ribs on the closure flange;

FIG. 20 is a sectional view of an alternative apparatus for forming a peelable seal and line of perforation at a single station;

FIG. 21 is a top view of the perforation forming apparatus taken along line 21—21 of FIG. 20;

FIG. 22 is an exploded perspective view of the perforation forming apparatus of FIG. 21;

FIG. 23 is a partial, perspective schematic view of the pouch separating mechanism of the present invention;

FIG. 24 is a side elevational view of the pouch separating mechanism of FIG. 23;

FIG. 25 is a plan view of the pouch separating mechanism taken along line 25—25 of FIG. 24;

FIG. 26 is a plan view of the pouch separating mechanism taken along line 26—26 of FIG. 24; and FIG. 27 is an end view of the pouch separating mechanism taken along line 27—27 of FIG. 24.

DETAILED DESCRIPTION OF THE PREFERRED EMBODIMENTS

The invention is generally embodied in a reclosable pouch and a method and apparatus for forming, filling, and sealing the pouch.

FIGS. 1–4 illustrate a first embodiment of the invention, comprising a pouch 10 which has first and second generally rectangular walls 12, 14 sealed to one another along their bottom edges 16, 18 and side edges 20, 22. Extending across upper portions of the respective walls are closure members 24, 26.

Each closure member 24, 26 has a substantially planar outer surface 28, 30 which is sealed to its respective associated wall. On their inner surfaces the closure members have complementary interlocking zipper profiles 32, 34 extending horizontally along their entire lengths to provide reclosability for the pouch 10. A non-peelable upper seal 36 is provided along the upper edge of the pouch between upper portions 35, 37 of the closure members 24 and 26. A plurality of gripper beads 38 extend longitudinally above the zipper profiles 32, 34 on the respective closure members 24 and 26 between the zipper profiles and the upper seal 36. In the illustrated embodiments, each closure member has a single pair of gripper beads 38 formed thereon to facilitate manual gripping and separation of the fastener profiles 32 and 34.

Extending longitudinally beneath the zipper profiles and parallel thereto is a hermetic peelable seal 39. The peelable seal is comprised of strips of polymeric material **39*a*, 39*b* on the respective closure members 24 and 26. The strength of the peelable seal 39 is such that it can be readily opened by application of manual outward force to the closure members 24 and 26 by the consumer, but is not susceptible to accidental opening due to normal stresses associated with product containment during the FFS operation, and subsequent shipping, handling, and display. The seal preferably has an opening force of from about 1.5 to about 6.0 lbs., and more preferably from about 2.5 to about 3.5 lbs. The peelable seal 39 is substantially impermeable to air, as well as to liquids which may be present in the pouch. Accordingly, the location of the peelable seal interiorly of the zipper profiles 32 and 34** prevents any contents of the pouch from leaking into the zipper profiles and excludes the interlocking members of the zipper from the hermetic seal area.

The strips of polymeric material **39*a*, 39*b*** which form the peelable seal preferably comprise polymeric materials which are known in the art to be suitable for this purpose, such as one or more of the following: polyethylene/EVA with a VA content of between 4% and 22%; polybutylene; Surlyn; Bynel; Saran (PVDC) copolymer; ethylene acrylic acid copolymer; or methacrylic acid copolymer. As disclosed in, e.g., U.S. Pat. No. 4,782,951, the disclosure of which is incorporated herein by reference, a hermetic peelable seal may be formed between a Saran copolymer lamina and an EVA lamina.

Each of the pouch walls 12 and 14 is preferably made of a suitable laminated material having barrier properties which, when sealed as described herein, provide hermeticity for the pouch. For purposes of example, a suitable film for cheese shreds may comprise a linear low-density polyethylene inner layer in combination with a polyester or nylon outer layer, and a middle adhesive layer of polyethylene. A nylon outer layer is particularly useful in connection with Swiss cheese, where a degree of $CO_2$ gas permeability is desirable in the packaging. The closure members 24 and 26 are preferably made of a low EVA content polyethylene. The closure members may be attached to the walls by, e.g., a thin layer of Surlyn on each of the closure members and the walls.

Figure 1:
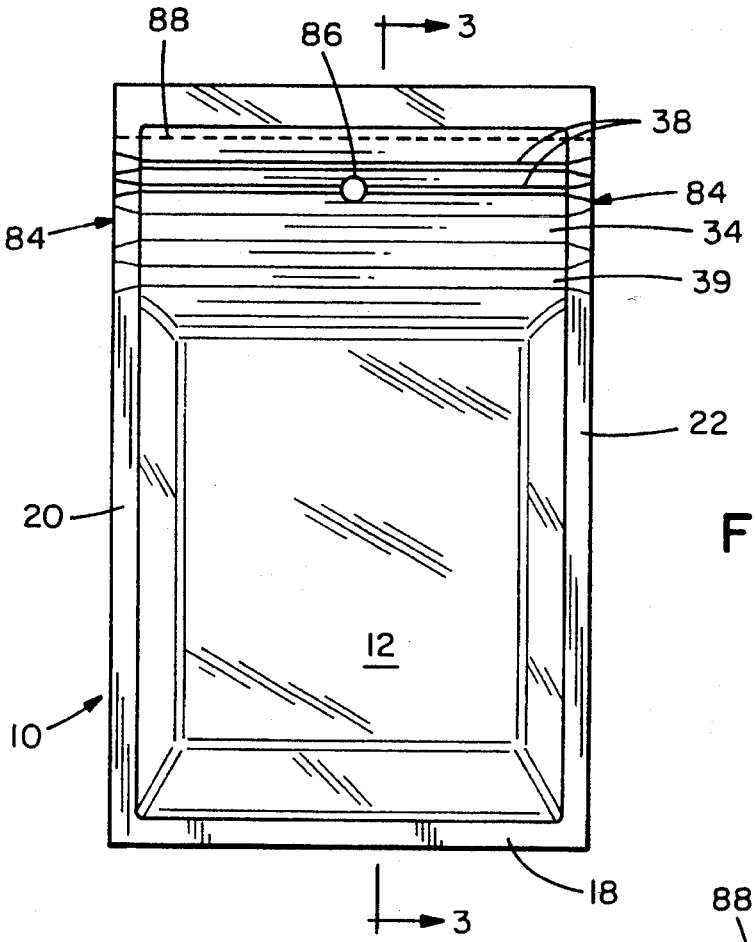
FIG. 1 is an elevational view of a pouch in accordance with a first embodiment of the invention.
Figure 2:
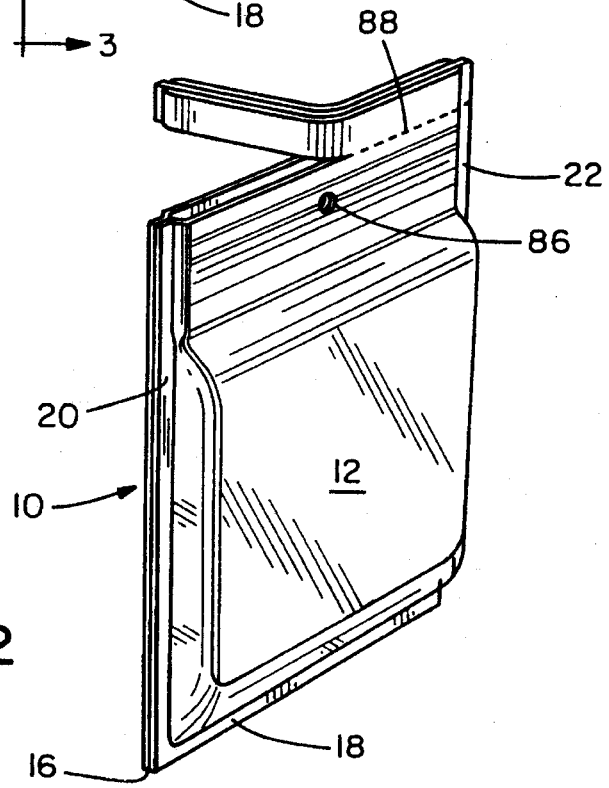
FIG. 2 is a perspective view of the pouch of FIG. 1, showing a removable portion of the pouch being torn away to permit access to the interior thereof.
Figure 3:
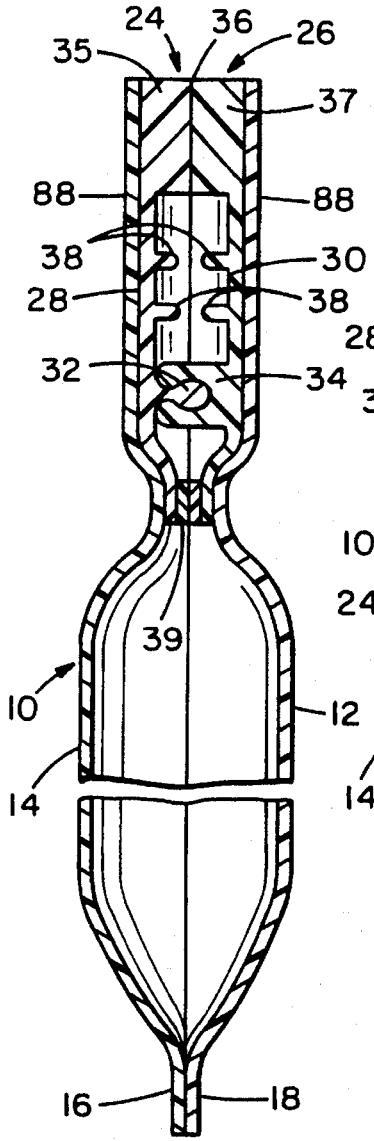
FIG. 3 is a sectional view taken substantially along line 3—3 in FIG. 1.
Figure 4:
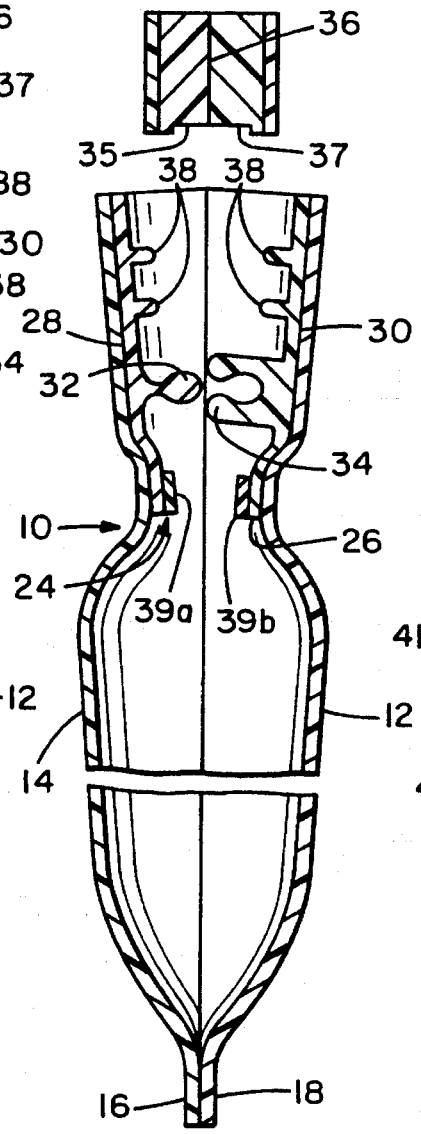
FIG. 4 is a sectional view similar to that of FIG. 3, showing the pouch in an opened configuration.

To facilitate support of the pouch 10 on a display hanger, a hole 86 is provided in an upper portion of the pouch. The hole extends through upper portions of the walls 12, 14 and through the closure members 24 and 26, which provide a relatively tough and strong periphery for the hole to support the weight of the pouch. As shown in FIG. 1, one or more of the ribs or beads 38 may extend over the hole to further increase the ability of the pouch to resist tearing at the hole 86 when subjected to rough handling during placement on a retail display rack and/or removal therefrom. Disposition of the hole above the peelable seal 39 enables hermeticity to be maintained. One or more lines of weakness 88 are formed through the walls 12, 14 and closure members 24, 26 immediately beneath the upper portions 35, 37 of the closure members to enable the upper portion of the pouch to be torn off, enabling easy manual access to the gripper beads 38 for separation of the zipper profiles 32, 34 and peelable seal strips **39*a*, 39*b*. The lines of weakness 88 in the illustrated embodiment take the form of perforations formed opposite one another through the respective walls and closure members. The placement of the perforations 88 above the hole 86 enables the pouch to be supported by a display rack without subjecting the line of perforations 88** to transverse tensile stresses which might cause accidental tearing thereof.

Figure 5:
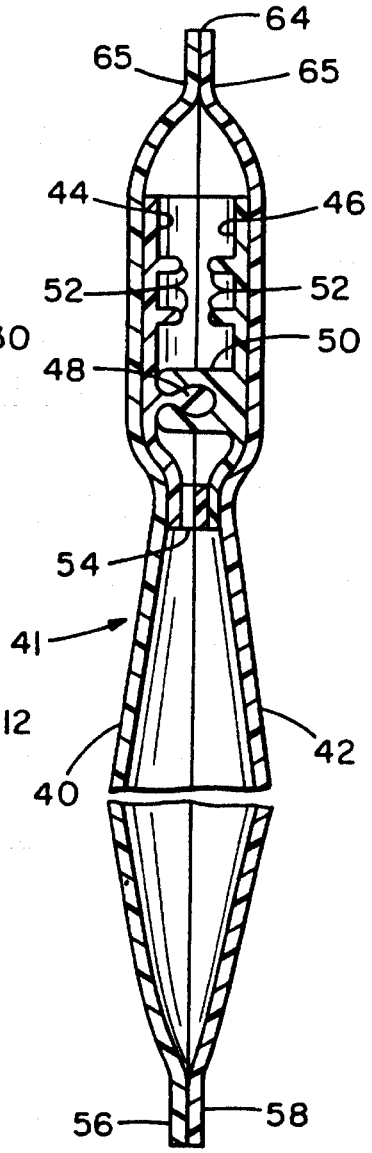
FIG. 5 is a sectional view similar to that of FIG. 3, illustrating a pouch in accordance with a second embodiment of the invention.
Figure 8:
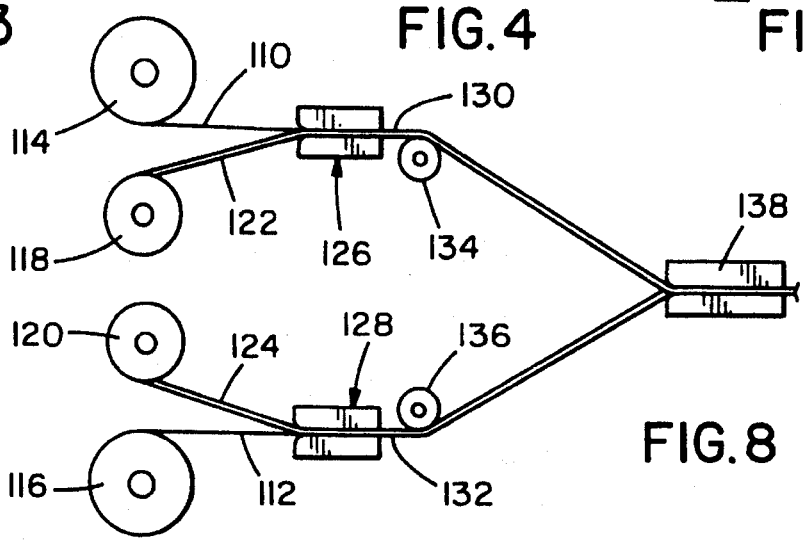
FIG. 8 is a fragmentary, diagrammatical plan view of apparatus in accordance with an alternative embodiment of the invention.

FIG. 5 illustrates a pouch 41 in accordance with a second embodiment of the invention. The pouch of FIG. 5 is generally similar to that of FIGS. 1–4, in that it comprises a pair of generally rectangular walls 40 and 42, in combination with a pair of closure members 44 and 46 having interlocking zipper profiles 48 and 50 thereon. Gripper beads 52 are provided above the zipper profiles and a peelable seal 54 extends therebelow. The walls 40 and 42 are sealed to one another along their bottom edges 56, 58 and side edges. However, the pouch of FIG. 5 differs from that of FIGS. 1–4 in that its upper seal 64 is formed directly between the walls 40 and 42 of the pouch, rather than between the closure members. To this end, the closure members 44 and 46 are spaced beneath the upper edges of the walls 40 and 42, leaving a peripheral area along the top of each wall for the upper seal 42. As in the embodiment of FIGS. 1–4, a hole for receiving a display hanger is punched through an upper portion of the pouch, and lines of weakness, e.g., perforations 65, are provided opposite one another in the walls immediately beneath the seal area 64.

It is appreciated that the walls of the pouch may be constructed of a single web, rather than two separate webs. The pouch constructed in accordance with the single web is substantially similar to that of FIG. 5, except that the pouch material is continuous along its upper edge, rather than comprising two separate walls joined by a seal, and the pouch material provides a snug fit around the upper edges of the closure members 44 and 46. As in the other embodiments, a hole for receiving a display hanger is disposed adjacent the top of the pouch, with lines of perforation therebeneath.

Figure 6:
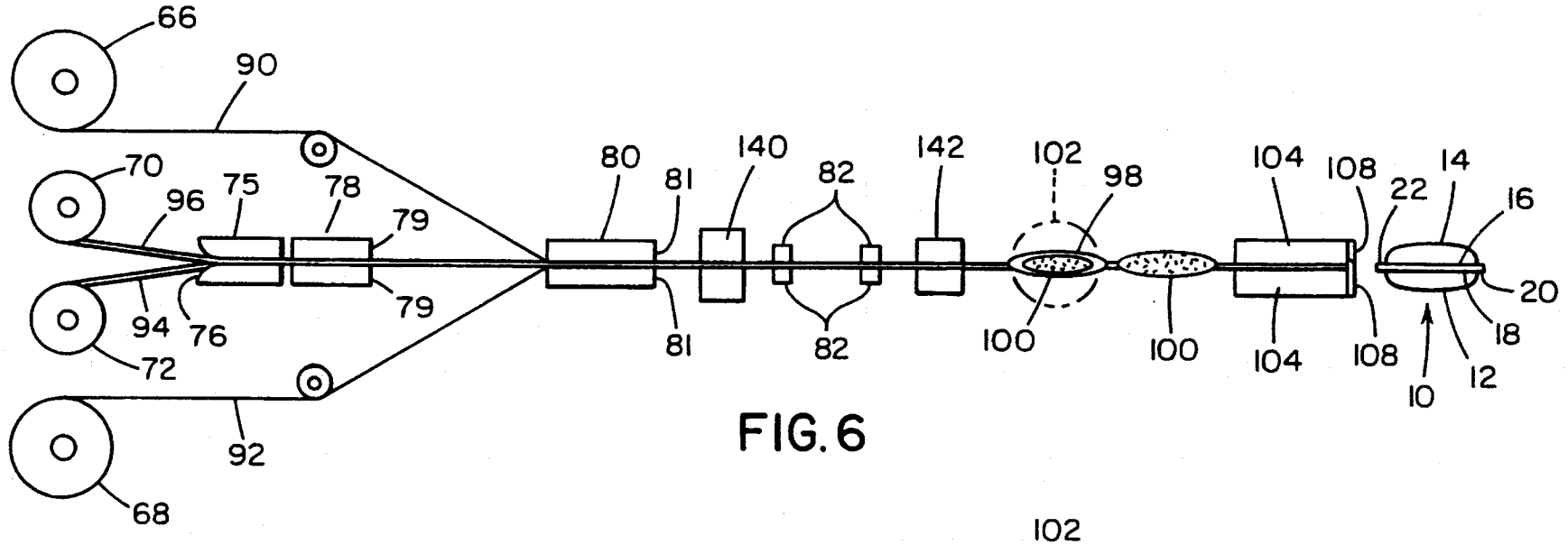
FIG. 6 is a diagrammatical plan view of apparatus for forming, filling and sealing pouches in accordance with a first embodiment of the invention.
Figure 7:
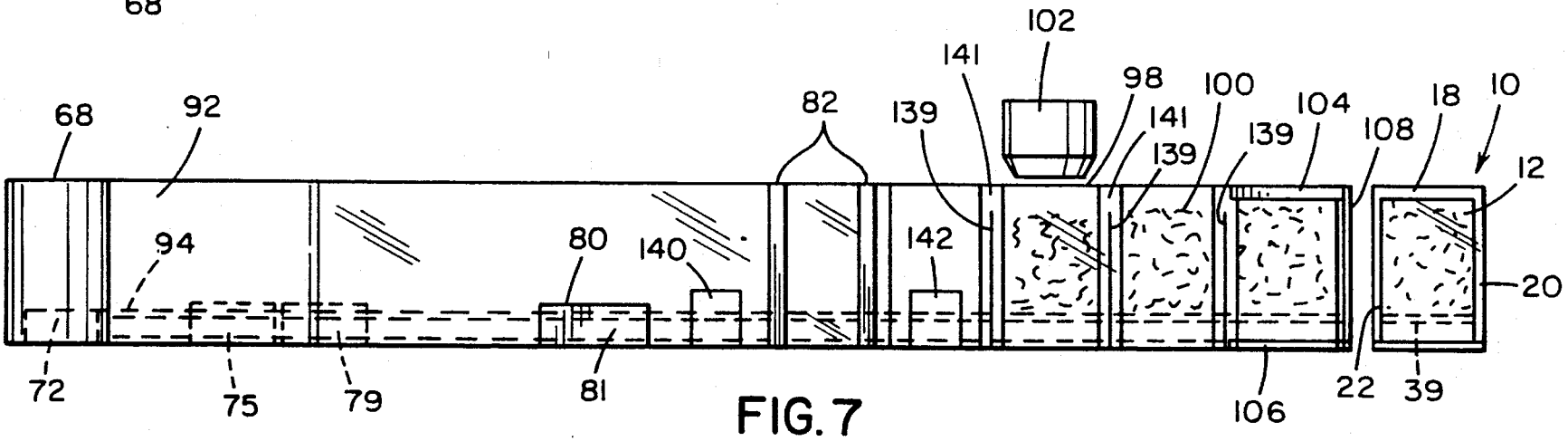
FIG. 7 is an elevational view of the apparatus of FIG. 6.

FIGS. 6 and 7 illustrate a method and apparatus for forming, filling and sealing pouches in accordance with a first embodiment of the invention. As described below, the pouches are formed, filled and sealed in an inverted configuration. The method will be described with reference to the pouch 10 described above with reference to FIGS. 1–4, by describing the successive steps involved in the formation, filling and sealing of the pouch 10 in its inverted configuration.

In the embodiment of FIGS. 6 and 7, the material for the walls is provided by first and second rolls 66 and 68 of suitable laminated film in web form. The material for the closure members is provided by first and second rolls 70 and 72 of closure strip material. The wall material as supplied by rolls 66 and 68 comprises webs 90 and 92 of laminated polymeric material. The, closure strip material comprises a first continuous strip 94 having a female zipper profile thereon, and a second strip 96 having a male profile thereon.

The first step in the method of FIGS. 6 and 7 is mating the complementary zipper profiles 32 and 34, i.e., pressing the zipper profiles into interlocking engagement with one another. This step is carried out at a zipper-assembly station 74 which comprises a shoe 75 having an internal surface 76 configured to maintain the opposite profiles in alignment relative to one another, and to cam the closure strips 94 and 96 into interlocking engagement as they advance through the shoe.

The next step is to form the peelable seal 39 between the closure members 24 and 26 at a sealing station 78. At the sealing station 78, a pair of horizontally oriented, reciprocable heat seal bars 79 are advanced toward one another to apply pressure and heat to the lower portions of the closure members which are to form the peelable seal 39. The advancement of the closure strip material is intermittent, so that the strip material is at rest while the heat seal bars 79 are closed.

The next step comprises sealing of the outer surfaces of the closure strips 94 and 96 to the inner surfaces of their respective associated wall webs 90 and 92. This is accomplished at an assembly/sealing station 80 at which a second pair of horizontal heat sealing bars 82 are employed to effect the desired sealing. The closure strips are positioned along the lower edges of the wall webs as the pouch is formed in its inverted configuration, so that they will extend across the top of the finished pouch in its upright configuration.

In the preferred embodiment, the line or lines of weakness 88 are then formed by a conventional notched perforation wheel on the line at a perforation station 140. (However, in an alternative embodiment of the apparatus the lines of weakness are formed by a reciprocating perforating blade, as described further below.) Next, the side margins of the pouches are sealed by vertical sealing bars 82. In forming the side seals, the sealing bars 82 crush the closure strips at the areas 84 which correspond to the ends of the closure members 24 and 26 in the finished pouch. The sealing bars provide an impermeable marginal seal area on each side of the pouch being formed, along the entire vertical dimension of the pouch, or at least from the bottom edges 16, 18 of the walls through the peelable seal 54. The vertical sealing bars 82 preferably include cutting elements to form vertical slits 139 in the wall webs 90 and 92, extending upward from the bottom edges of the respective wall webs to a predetermined level, leaving links 141 of wall material intact along the upper edges of the wall webs, while partially separating the pouches from one another.

The peelable seal 39 having been formed between the closure members, the formation of the side seals enables product 100 to be retained in each of the pouches being formed. The as-yet-unsealed bottom 98 of the inverted pouch is held open to provide an opening to receive the product, and the pocket is filled to a desired level through a dispensing spout 102, with the peelable seal 29 preventing the product from reaching the zipper. The inverted pouch is then gas flushed with $N_2$ or $CO_2$, closed, 'and sealed along its horizontal top and bottom edges by additional horizontally-oriented sealing bars 104 and 106. The pouch 10 is cut from the preceding and succeeding pouches by vertically oriented knives 108 which sever the links 141 and trim the side edges of the pouches, to complete the FFS operation.

Where a punched hole 86 is desired, punch apparatus 142 may be provided at a convenient location on the line. In the apparatus of FIGS. 6 and 7, the punching operation takes place immediately after sealing of the vertical seals of the pouch, and prior to filling. In other embodiments of the invention, the order of the steps may be varied. For example, the first and second webs 110, 112 of wall material may be provided by first and second rolls 114 and 116, which are supported for rotation about vertical axes. Material for closure members may be provided by first and second rolls 118 and 120 of closure strip material. One roll supplies closure strip 122 having a female profile, while the other provides material 124 having a male profile.

Figure 8A:
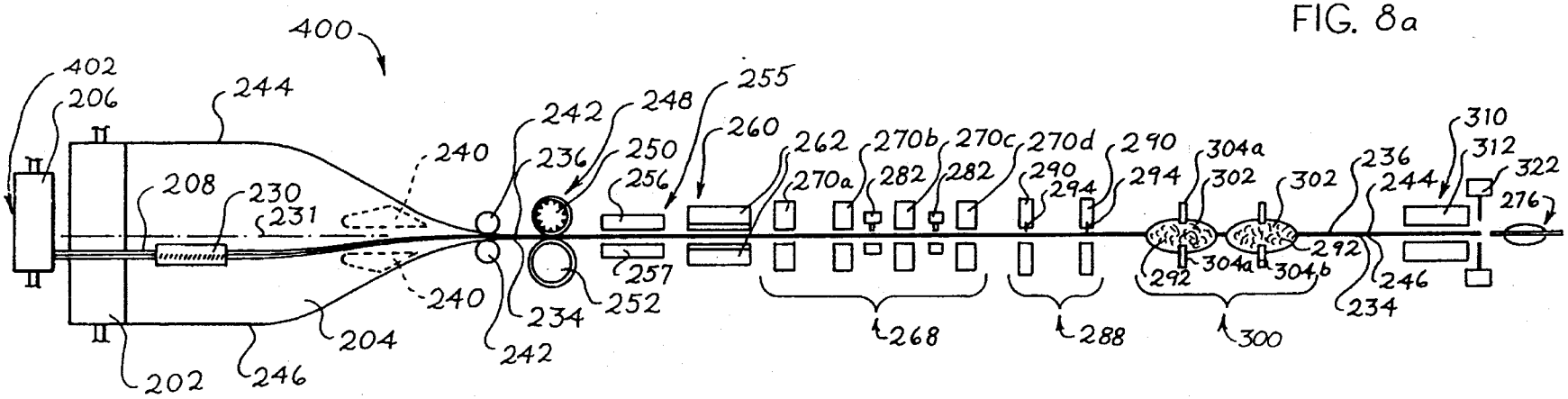

In the embodiment of FIG. 8*a*, the lengths of closure strip material 122 and 124 are joined to their respective associated webs of wall material 110 and 112 at two parallel heat sealing stations 126 and 128. The resulting composite webs of wall and fastener material 130 and 132 then advance over vertical guide rollers 134 and 136 to a sealing assembly station 138 where the zipper profiles of the closure material are interlocked, and the peelable seal formed in a manner similar to that described above with reference to the embodiment of FIGS. 6 and 7. The remaining steps of forming the side seal, filling, forming top and bottom seals, and separating the finished pouches would then be carried out as described in the embodiment of FIGS. 6 and 7.

In another embodiment of the invention (not shown) the formation of the peelable seal is combined with the operation of sealing the fastener strips to the webs of wall material. This method is similar to that of FIGS. 6 and 7, except that the sealing station 78 may be eliminated, and the assembly/sealing station 80 adapted to provide heat and pressure to effect both sealing operations simultaneously.

A third embodiment of apparatus for forming, filling and sealing pouches of polymeric material is illustrated in FIGS. 8–17, with the pouch produced illustrated in FIGS. 18 and 19. The method of this preferred embodiment will be described in detail first, and then the apparatus for carrying out this method will be described.

The first step of the method for forming, filling and sealing the pouch shown in FIGS. 18 and 19 is to provide a continuous roll 202 of longitudinally extending polymeric sheet or web 204, and a continuous roll 206 of polymeric closure strip 208 having interconnected complementary male closure component 210 and female closure component 212. (see FIGS. 18 and 19) The male closure component 210 and female closure component 212 each include respective flanges 214 and 216, one part of which includes complementary respective male profile 218 and female profile 220 which profiles are known in the art and which matingly engage when pressed together to provide a seal and are easily separated when pulled apart.

The respective flanges 214 and 216 of the male and female closure components 210 and 212 have substantially planar surfaces 222 and 224 on the side of the flange opposite the complementary male and female profiles 218 and 220, such that the interconnected male and female profiles 218 and 220 lie situated between opposite, outer planar surfaces 222 and 224, as seen in FIGS. 18 and 19.

With further reference to FIGS. 18 and 19, the flanges 210 and 212 also include peelable seal strips 226 and 228 on the same side thereof as the profiles 218 and 220, so that the peelable seal strips 226 and 228 lie adjacent and opposing one another when the male and female profiles 218 and 220 are interconnected. The peelable seal strips 226 and 228 function as described above and will be discussed further below. The flanges 210 and 212 also include gripper beads 229 to facilitate manual gripping and separation of the fastener profiles 218 and 220.

With reference to the schematic views of FIGS. 8*a* and 9, the initial step is to seal one side of the closure strip 208 to the web 204 of polymeric material, with the other side of the closure strip 208 to be sealed to the plastic web 204 at a later stage. Either the male component 210 or the female component 212 of the closure strip 208 can be connected to the web 204 first, but for ease of understanding the invention, the method and apparatus will be described with reference to attachment of the male component 210 of the closure strip 208 to the web 204 first.

The closure strip 208 is brought into proximity with the web 204 with the web lying substantially in a horizontal plane and outer, planar side 222 of the flange 214 of the male component 210 of the interconnected closure strip 208 adjacent the horizontal web 204. With reference to FIGS. 8*a* and 9, a first heated sealing bar 230 is employed to apply heat and pressure to the male portion 210 of the closure strip 208 sufficient to adhere the planar side 222 of the flange 214 of the male component 210 of the closure strip 208 to the web 204. As discussed further below, it is preferred that the first heated sealing bar 230 act upon the flange 214 at a location offset from the profiles 218 and 220 so as not to detrimentally effect the closure profiles due to the heat of sealing.

As seen in FIG. 8*a*, the closure strip 208 is sealed to the web 204 slightly off-center. The closure strip 208 is spaced from the centerline 231 so that the closure strip 208 will be spaced from the fold 232 at which the sidewalls 234 and 236 meet when the web 204 is subsequently folded onto itself along the centerline 231, as will be described hereafter.

The web 204 and closure strip 208 are advanced together intermittently to bring successive portions of the web 204 and closure strip 208 beneath the first heated sealing bar 230. The first heated sealing bar 230 is intermittently raised and lowered in synchronization with the intermittent web and closure strip advancements to intermittently apply heat and pressure to adhere successive portions of the closure strip 208 to the web 204. For reasons to be explained in detail below, it is preferred that the web 204 and closure strip be intermittently advanced the length of approximately two pouch widths upon each intermittent advancement. The length of the first heated sealing bar 230 is made longer than the double pouch width distance of the intermittent web and closure strip advancements so that the first heated sealing bar forms a continuous web with closure strip attached thereto along its entire longitudinal length.

Thus, as the web 204 exits the first heated sealing bar it has closure strip 208 attached thereto with the male portion 210 thereof adhered to the web 204 off-center. The female portion 212 of the closure strip 208 is matingly interconnected with the male portion 210 with the planar side 224 of the flange 216 (FIG. 19) of the female portion 212 facing upward, opposite the web 204. It is preferred that the web 204 be oriented horizontally with the planar side 224 of the female portion 212 of the closure strip 208 facing upward at this stage, although other orientations may also be employed without departing from the inventive concepts set forth herein.

The web 204 with the closure strip 208 adhered thereto are repeatedly intermittently advanced together the length of two pouch widths in this orientation, to bring the web 204 into the folding station, at which folding bars 240 and folding rollers 242 fold the web 204 in half, over upon itself along centerline 231, to bring the opposite lateral edges 244 and 246 of the web 204 together. This forms a front sidewall 234 to which the male component 210 of the closure strip 208 is attached, and a rear sidewall 236, which sidewalls are joined along the centerline 231. The fold along the centerline 231 defines a folded or continuous end 232. Since the closure strip 208 is affixed to the web 204 off-center, the folding in half of the web 204 along centerline 231 results in the closure strip 208 being spaced from the folded end 232 of the folded web 204, as shown in FIG. 9.

As seen in FIG. 8*a*, in the preferred embodiment the folded web 204 is then brought first to a perforating station 248 upon the next intermittent advancement of the web 204, and then brought to a separate peelable seal forming station upon a subsequent web advancement. In an alternative embodiment, described further below, the perforation and peelable seal are formed generally simultaneously at a common station, rather than two separate stations.

At the preferred perforating station, a rotary perforating blade 250 and a backing roller 252, both positioned at a vertical height between the lower folded end 232 of the folded web 204 and the engaged male and female profiles 218 and 220 of the closure strip 208, continually press together on opposite sides of the folded web 204 thereat to form a line of perforation 254 (see FIG. 13) to allow for easy opening of the finished pouch. The perforations penetrate both the front sidewall 234 and the rear sidewall 236 as well as the closure member flanges 214 and 216. It may be desirable to provide for one of the closure flanges 214 or 216 to be shorter than the other so that the perforating blade 250 need only penetrate one of the two flanges in addition to the sidewalls. Reduction of the length of one of the flanges 210 or 212 may also be desired to reduce plastic flow upon formation of the side seals 27S. The blade 250 has notches of about 1/32 in. disposed at 3/4 in. intervals about the circumference of the belt. Thus, the line of weakness comprises a series of cuts of 3/4 in. length separated from one another by uncut segments of about 1/32 in. length.

The provision of the rotary perforating blade 250 and backing roller 252 arrangement provides significant advantages. An electric eye is employed to sense web position, and a servo drive system is employed to stop the web at desired positions. Horizontal variations of +/−1/16 in. and vertical variations of +/−1/32 in. from a desired position are to be expected. Most principally, there is some vertical and lateral play of the web 204 as it is repeatedly intermittently advanced and stopped. It is important that the line of perforation 254 be continuous across the entire length of the web 204 to allow easy, uninterrupted tearing off of the folded end 232 of the web 204 at the time of use to provide an opening for easy access to the contents of the pouch.

The web 204 may back up slightly when it is stopped at one of the pouch forming stations. The continuous contact provided by the perforating roller 252 and backing roller 254 arrangement provide a single, continuous line of perforation 254 across the length of the web 204 and, hence across the entire width of the pouches formed. Upon backing-up of the web 204, the perforating roller 250 retraces a short segment of the line of perforation 254, and does not create additional perforations. Thus, even if the web 204 were to become angled over a portion of its travel through the perforating station 248, the line of perforation 254 would then be angled thereat, but would still be continuous along the length of the web 204. The rotation of the perforating roller 250 is controlled in accordance with the web advancement by timing belts, as will be explained further below. Accordingly, a folded web 204 having the male component 210 of a closure strip 208 affixed to its front sidewall 234 and having a line of perforation 254 extending along its entire length, situated between the folded end 232 of the web 204 and the male and female profiles 218 and 220 of the closure strip 208, exits from the perforating station 248.

Upon the aforementioned folding of the web 204 onto itself, the planar side 224 of the female component 212 of the closure strip 208 was brought adjacent the rear sidewall 236. The planar side 224 of the female component 212 of the closure strip 208 is then adhered to the rear sidewall 236 by the application of heat and pressure thereat. The web 204 is advanced to the closure strip sealing station 255 whereat a second, horizontally extending heated sealing bar 256 is pressed against the rear sidewall 236 at a location offset from the closure strip 208 to seal the planar side 224 of the female component 212 of the closure strip 208 to the rear sidewall 236. Backing bar 257 serves as an abutment surface. The second heated sealing bar 256 extends approximately the length of two pouch widths, as is required to assure the attachment of the closure strip 208 is continuous along the longitudinal length of the web 204 with the double-pouch-width web advancements.

Thus, at this stage of manufacture, the male and female profiles 218 and 220 of the male and female components 210 and 212 of the closure strip 208 are matingly interconnected with one another, with each component adhered to respective opposite front and rear sidewalls 234 and 236, and spaced from the folded end 232 of the web 204. (See FIG. 9 and 18.) The web 204, at this stage, is oriented such that the folded end 232 thereof is at the bottom with the lateral edges 244 and 246 being at the top and unjoined. The peelable sealing strips 226 and 228 of the male component flange 214 and female component flange 216 are now positioned closely adjacent, and opposing one another.

Thereafter, as the web 204 and closure strip continue to be intermittently advanced, they are advanced to a peelable seal forming station 260 at which a pair of horizontally extending peelable sealing bars 262 apply heat and pressure to the sidewalls 234 and 236 at the location of the peelable seal strips 226 and 228 to fuse the opposing peelable sealing strip portions 226 and 228 of the male and female closure components 210 and 212 together to form a peelable seal 264 (see FIG. 18). As with the closure strip sealing bar 256, the peelable sealing bars 262 extend approximately two pouch widths in length to assure a continuous peelable seal 264 with the two-pouch-width web advancements.

It is preferred that the male component flange 214 and the female component flange 216 of the respective closure strips 210 and 212 be sealed to their respective sidewalls 234 and 236 at a location offset from the closure profiles 218 and 220 so as to prevent detrimental heating of the complementary male and female closure profiles 218 and 220, which may result in improper engagement of the male and female closure components 218 and 220. More specifically, it is preferred that the heated sealing bars 230 and 256 seal the male component flange 214 and the female component flange 216 to their respective sidewalls 234 and 236 only over the portion of the flanges 214 and 216 below and spaced from the closure components 218 and 220 (referring, still, at this point to the pouch in its inverted orientation). The peelable sealing bars 262 adhere the portion of the male and female flange components 214 and 216 at the peelable seal strips 226 and 228 to the sidewalls 234 and 236, which peelable seal strips 226 and 228 are above and offset from the closure profiles 218 and 220. Thereby, the male and female flanges 214 and 216 are adhered to their respective sidewalls 234 and 236 both above and below the location of the closure profiles 218 and 220, with the portion of the flanges 214 and 216 immediately at the closure profiles 218 and 220 remaining unsealed to the sidewalls.

With continued reference to the upside-down orientation of the pouches, with the closure strip 208 near the folded, lower end 232, the peelable seal 264 is thus formed spaced slightly above the interconnected male and female profiles 218 and 220 of the closure strip 208 so that the peelable seal 264 extends horizontally between the male and female profiles 218 and 220 of the closure strip 208 and the upper, open end 266 of the web 204 the upper ends of the sidewalls being adjacent, and having unsealed lateral edges 244 and 246.

Thus, during filling, in which articles are loaded through the open upper end 266 of the web 204, as described below, the peelable seal 264 prevents the articles from contacting the zipper profiles 218 and 220 during filling. The peelable seal 264 acts as a barrier, with the articles being supported thereabove and isolated from the closure strip 208 which is below the peelable seal 264. The peelable seal strips 226 and 228 are made of a material which, when heated for a predetermined period at a predetermined temperature, allows easy separation of the peelable seal strips when they are pulled apart.

Upon formation of the peelable seal 264, the two sidewalls 234 and 236, two flanges 214 and 216, and two peelable seal strips 226 and 228 are all bonded integrally with one another to form a six layer laminate at the location of the peelable seal strips. The portions of the flanges 214 and 216 at which the peelable seal strips 226 and 228 are located are bonded securely to respective sidewalls 234 and 236, as best seen in FIG. 18.

Bonding of the portion of the flanges 214 and 216 at the location of the peelable seal strips 226 and 228 to the sidewalls 234 and 236 is effected simultaneously with bonding of the peelable seal strips 226 and 228 to one another, by the pair of horizontally extending peelable sealing bars 262 applying heat and pressure to the sidewalls 234 and 236 at the location of the peelable seal strips 226 and 228. This would normally elevate the temperature at the interface of the peelable seals 226 and 228 to approximately the same temperature as the interface between the flanges 214 and 216 and their respective sidewalls 234 and 236.

It may be desirable to provide greater heat at the interface of the flanges 214 and 216 and their respective sidewalls 234 and 236 than at the interface of the two peelable seal strips 226 and 228. A relatively lower heat at the interface of the peelable seal strips 226 and 228 may be required to assure an easily separable seal thereat, whereas the higher temperature is desirable for permanently bonding the flanges 214 and 216 to the sidewalls 234 and 236. Excessive heat transfer to the peelable seal would render it incapable of opening properly.

By providing a plurality of ribs 263 on the outer surfaces 222 and 224 of the flanges 214 and 216 at the location opposite the peelable seal strips 226 and 228, as shown in FIG. 9A, less heat is transferred to the peelable seal strips 226 and 228 as compared with the heat imparted to the sidewalls 234 and 236 and flanges 214 and 216. When subjected to the heat and pressure of the peelable sealing bars 262, the ribs 263 are sealed to respective sidewalls 234 and 236. The ribs 263 serve as a heat sink and the air gaps between adjacent ribs serve as an insulator, with the combination thereof serving to reduce the heat imparted to the peelable seal strips 226 and 228. Thus, significantly higher temperatures are realized at the interface of the ribs 263 and sidewalls 234 and 236 as compared to the temperature at the interface of the two peelable seal strips 226 and 228, when ribs 263 are employed.

As an alternative to the ribs 263, a solid block of adhesive extruded with the closure strips 210 and 212 opposite the peelable sealing strips 226 and 228 may be employed. Use of a solid block of adhesive may be undesirable in that it may be susceptible to curling due to different rates of thermal expansion of the adhesive and the closure strip material. Similarly, an adhesive layer may be laminated onto the closure strips 210 and 212 opposite the sealing strips 228 and 230, rather than being coextruded.

Following formation of the peelable seal, as the web 204 and closure strip 208 continue to be intermittently advanced by two pouch widths, they are advanced to a closure strip sealing and hole punching station 268. When the web 204 is at rest thereat, four heated crushing bars or other sealing apparatus 270, spaced longitudinally approximately one pouch width apart, seal the male and female closure component profiles 218 and 220 together at one bag width intervals. The sealed closure strip portions 272 are spaced approximately one pouch width apart from one another to correspond to the location of the lateral ends 274 of the completed pouches 276 (see right side of FIG. 9).

That is, as described further below, the front and rear sidewalls 234 and 236 are sealed together along a substantial portion of their vertical length at one bag width intervals to form side seals 278 at the location of the crushed closure portions 272. The sidewalls 234 and 236 are then cut at the location of the side seals 278 to form a plurality of separate pouch compartments having lateral sides defined by the side seals 278. The sealed closure portions 272 thus form the ends 280 of the closure strip 208 of each pouch, and serve to both form a positive seal at the lateral ends 280 of the closure strip 208 to prevent separation of the lateral ends of the closure strip upon separation of the male and female closure component profiles 218 and 220.

As seen in FIG. 8*a*, four equally-spaced, heated crushing bars or other sealing means 270*a*, 270*b*, 270*c*, and 270*d* are employed. While ultrasonic sealing apparatus may be employed, these are too slow in forming the desired closure strip seals, and therefore heated sealing bars are preferred. While in the preferred embodiment of the invention, the web 204 is advanced two pouch widths upon each intermittent advancement thereof and the pouches filled in pairs, with four sealing apparatus 270*a*, 270*b*, 270*c* and 270*d* spaced one pouch width apart, other arrangements falling within the scope of the invention may also be desirable. For instance, the web 204 may be advanced intermittently three bag widths, with six sealing apparatus employed and spaced one bag width apart, to allow simultaneous filling of 3 pouches.

With this spacing and web advancement, the portion of the closure strip 208 which was sealed by heated crushing bar 270*a* is then advanced two pouch widths to heated crushing bar 270*c* whereat the closure strip 208 is sealed at the same location again. Similarly, the portion of the closure strip 208 which was sealed by heated crushing bar 270*b* is then advanced two pouch widths to heated crushing bar 270*d* whereat the closure strip 208 is sealed at the same location again. Hence, the one pouch width spaced portions of the closure strip 208 which are sealed, are each sealed twice thereat to assure proper sealing of the ends of the closure strips.

Positioned midway between the second and third heated crushing bars 270*b* and 270*c*, and midway between the third and fourth heated crushing bars 270*c* and 270*d*, are hole punch devices 282. Hence, the two hole punch devices 282 are also spaced one pouch width from one another. While the web 204 is at rest at the closure strip sealing and hole punching station 268, between the intermittent advancements of the web 204 therethrough, the hole punch devices 282 both punch a small hole 284 through the front and rear sidewalls 234 and 236 between the engaged male and female profiles 218 and 220 of the closure strip 208 and the line of perforation 254, and, approximately midway between the adjacent closure strip crushings 272.

Hence, upon the next intermittent advancement of the web 204 and closure strip 208, the portion of the web exiting the closure strip crushing and hole punching station 268 has the closure strip 208 sealed at two locations, the interval between adjacent seals 272 being approximately equal to the desired pouch width, with the lower end 232 of the folded web 204 having a hole 284 therethrough to accommodate a support hook by which the pouch may be hung for display.

The web 204 and closure strip 208 are then advanced two pouch widths upon the next intermittent advancement thereof to a side seal forming station 288 at which a pair of vertically extending heated sealing bars 290 are intermittently pressed against opposite sides of the sidewalls at the location of the closure strip seals to apply sufficient heat and pressure to seal the front and rear sidewalls 234 and 236 together thereat to form a pair of substantially vertical side seals 278 joining said front and rear sidewalls 234 and 236 at one bag width intervals. This defines a pocket 292 having a width determined by the distance between said vertical side seals 278, as mentioned above.

The side seals 278 extend from the lower, folded end 232 of the web 204 to near the lateral edges 244 and 246 at he upper end of the folded web.

Vertically oriented knives, indicated schematically at 294 in FIG. 9, cut the web 204 while it is at rest at the side seal forming station 288, forming cuts 296 near the middle of the formed side seals 278. The cuts 296 extend from the lower, folded end 232 of the web 204 terminating near the lateral edges 244 and 246 at the upper, open end 266 of the partially formed pouches.

Thus, a plurality of pouches are substantially formed which are substantially slit therebetween. The pouches remain attached to one another near the upper end of the sidewalls 234 and 236, due to the fact that the slits do not extend the entire vertical length of the sidewalls. A small section 314 at the upper sidewall edges 244 and 246 remains uncut. The pouches are not completely separated from one another until the last stage of the production process, after the partially formed pouches have been filled and sealed, as explained further below.

Each of the pouches has a pocket 292 between the front and rear sidewalls 234 and 236 defined by the peelable seal 264 at the lower end, side seals 278 at the lateral sides, and open at the upper end 266 to allow filling of the pouches thereat into the pocket 292, as described below.

The web 204, which has now been partially formed into pouches, is then advanced to a filling station 300 at which the upper, lateral edges 244 and 246 of the partially formed pouches are separated to form a filling opening 302 (see FIG. 8*a*). Pairs of fingers 304*a* and 304*b* extend down between the front and rear sidewalls 234 and 236 at the upper, lateral edges 244 and 246 thereof.

The pairs of fingers 304 are pressed together as the web 204 is advanced. Since the side seals 278 do not extend completely to the upper, lateral edges 244 and 246 of the sidewalls 234 and 236, and the fingers 304 do not extend down to the sidewalls 278, there is no interference of the sidewalls with the fingers 304 upon web advancements.

While the web 204 is at rest between successive intermittent advancement, the fingers 304 are approximately midway between adjacent side seals 278. The fingers 304 separate, pulling the upper edges 244 and 246 of the sidewalls 234 and 236 in opposite directions to present the filling opening 302 through which articles are loaded into the pocket 292 of the partially formed pouches. As seen schematically in FIG. 8*a*, two pairs of fingers 304*a* and 304*b* are employed which allow the simultaneous filling of two pouches at a time. The peelable seal 264, which had been formed earlier at the peelable seal forming station 260, prevents the articles from contacting the male and female profiles 218 and 220 of the closure strip 208 during loading, and also later during storage of the pouches, to eliminate interference with proper operation of the closure strip 208.

During the interval that the upper edges 244 and 246 of the sidewalls 234 and 236 are separated by the fingers 304*a* and 304*b* to form the filling openings 302, articles are loaded downward into the pockets 292 of the pouches through loading chutes 305 to fill the pouches to a predetermined level. The finger pairs 304*a* and 304*b* are then brought back together for the next web advancement, which brings two more pockets 292 into registration with the two finger pairs 304*a* and 304*b* and loading chutes 305.

After the web 204 has been substantially formed into pouches and the partially formed pouches filled, in the aforementioned manner, they are advanced to an end closure station 310 at which the open, upper edges 244 and 246 of the sidewalls 234 and 236 are sealed together to form an upper seal 311 to enclose the articles within the pocket 292. (See FIGS. 9, 18 and 14.) Horizontal heated closure bars 312 apply heat and pressure to form the seal at the upper edges 244 and 246 of the front and rear sidewalls 234 and 236, thereby hermetically sealing the articles within the pocket 292 of the pouch. The closure bar 312 is approximately two pouch widths in length, to correspond to the double pouch width web advancements.

Also at the sealing station 310, the narrow portion 314 of web 204 still interconnecting the pouches near their upper edges 244 and 246 is then cut by separating blades 322 to separate the formed, filled and sealed pouches 320 from the remainder of the web 204. An alternative to separating the pouches by the use of separating blades 322 is use of a pouch separating mechanism 500, such as that illustrated in FIGS. 23–27, and described further below.

Thus, two separate pouches are produced at a time in which the user need merely tear the folded end 232 of the pouch 320 off at the line of perforation 254 (see FIG. 19), then pull the sidewalls 234 and 236 apart at their upper edges 244 and 246 with sufficient force to separate the male and female closure component profiles 218 and 220, and peel the peelable seal 264 apart, to allow access to the product stored within the pocket 292 of the pouch 320. The pouch is easily resealable by rejoining the male and female closure component profiles 218 and 220, to maintain freshness of the product stored within the pouch interior.

The method of forming, filling and sealing the pouch having been explained, the apparatus for carrying out the method will now be described in greater detail.

The overall form, fill and seal apparatus is shown schematically in FIG. 8*a*, and referred to generally at 400. At the raw material end 402 of the apparatus 400 is situated a roll 202 of polymeric sheet material or web 204 and a roll 206 of closure strip material 208 having interconnected, complementary male and female components 210 and 212.

The closure strip 208 is unrolled from the roll 206 by a closure strip unwind unit such as that shown in FIGS. 17–19, and indicated generally by reference numeral 404. The path of travel of the closure strip 208 is indicated in FIGS. 15–17 by broken lines. As the closure strip 208 is unrolled from the roll 206, it passes through eyelet 408 which supports the closure strip in an elevated position. The closure strip 208 then passes around recessed guiding wheels 406. The guiding wheels 406 have a recess 410 therein, as shown in FIG. 18, to accommodate the thickened portion of the closure strip 208 at which the male and female closure component profiles 218 and 220 are located.

Thereafter, the closure strip 208 passes to powered roller 412 which effects advancement of the closure strip 208. The powered roller 412 is driven by a motor which rotates the powered roller 412 intermittently a predetermined amount to advance the closure strip 208. A pressure roller 414 is biased toward the powered roller 412 and exerts a continual force thereagainst. The closure strip 208 passes between the powered roller 412 and the pressure roller 414 with the pressure roller 414 assuring positive frictional engagement of the closure strip 208 with the powered roller 412. Hence, as the powered roller 412 is intermittently rotated, the closure strip 208 is intermittently advanced a corresponding amount.

The powered roller 412 and pressure roller 414 both have respective channels 416 and 418 which are aligned with one another to accommodate the enlarged middle portion of the closure strip 208 at which is located the male ad female closure component profiles 218 and 220. Hence, the male and female flange sections 214 and 216 on either side of the enlarged middle portion of the closure strip are pressed between the powered roller 412 and the pressure roller 414 to effect advancement of the closure strip without distorting the enlarged central portion of the closure strip.

As stated above, it is necessary to maintain the requisite continuous force of the pressure roller 414 against the powered roller 412 to assure proper positive frictional engagement between the closure strip 208 and the powered roller 412, and hence assure accurate advancement of the closure strip 208. To maintain this force, the pressure roller 414 is mounted for pivotal movement about pivot pin 420, and is biased toward the powered roller 412 by a spring 422, as best seen in FIG. 18.

After passing between the powered roller 412 and the pressure roller 414, the closure strip 208 passes around dancing ring 424 and small roller 426 before exiting the closure strip unwind unit 404 through second eyelet 428. Both the dancing ring 424 and small roller have a channel therein (not shown), similar to the channels 416 and 418 provided in the powered roller 412 and the pressure roller 414, respectively.

The channels provided on the rollers of the closure strip unwind unit 404 may have their width and profile changed by any of several different methods. In the preferred embodiment of the invention, the entire closure strip unwind unit 404 is modular and interchangeable. The motor remains in place as unwind units 404 corresponding to the particular size and shape of the closure strip 208 being run are interchanged on the motor shaft. Hence, this arrangement assures accurate two bag width closure strip advancements.

After exiting the closure strip unwind unit 404, the closure strip 208 passes beneath first heated sealing bar 230, as illustrated in FIG. 8*a*. The first heated sealing bar 230 also includes a channel therein to accommodate the enlarged center portion of the closure strip 208. The first heated sealing bar 230 is raised and lowered intermittently, which raising and lowering is synchronized with the intermittent advancement of the closure strip 208 and plastic web 204. Hence, the first heated sealing bar 230 is raised upon each advancement of the plastic sheet 204 and closure strip 208, and lowered between successive advancements, during which the closure strip and web are stationary beneath the first heated sealing bar 230.

The first heated sealing bar 230 applies heat and pressure to the flanges 214 and 216 of the closure strip 208 each time it is lowered to bond the planar surface 222 of the male flange 214 to the plastic web 204. The temperature of the heated sealing bar 230 is controlled electronically to maintain the sealing bar 230 at a suitable temperature, which temperature will vary depending upon the production rate and the materials employed. By providing for the length of the first heated sealing bar 230 to be greater than the two-pouch-width length of plastic web 204 and closure strip 208 advancements, the intermittent seals formed by the first heated sealing bar overlap one another to assure that the entire length of closure strip 208 is sealed to the plastic web 204, without any gaps.

As discussed above and explained further below, the closure strip 208 is affixed to the plastic web 204 off-center thereof (see FIG. 8*a*). In the illustrated example, the male component 210 of the closure strip 208 is affixed to the plastic web 204 by the first heated sealing bar 230 and is affixed closer to lateral edge 246 than to lateral edge 244.

After passing beneath the first heated sealing bar 230, the plastic web 204, with the closure strip 208 bonded thereto, is brought to folding station 241 at which the plastic web 204 is folded in half along the centerline 231 to bring the opposite longitudinal ends 244 and 246 of the plastic web 204 together. Folding bars 240 appropriately positioned in the path of travel of the plastic web 204 deflect the lateral ends 244 and 246 of the plastic web 204 upward while maintaining the center of the plastic web lowered, to partially fold the web, as best seen in the plan view of FIG. 8*a*. Then the plastic web 204 is passed between folding rollers 242 which complete the folding operation by creasing the plastic sheet along the centerline 231 to form a folded end 232. The folding rollers 242 also press the sections of the web 204 on either side of the fold together to form opposing sidewalls 234 and 236.

Immediately after passing through the folding rollers 242, the folded web 204 is engaged near the upper edges 244 and 246 of the sidewalls 234 and 236 by supporting belts 432 and 434 which press together on opposite sides of the folded polymeric web to transport the web 204 to each of the subsequent pouch forming, filling and sealing stations.

The pair of supporting belts 432 and 434 press together on opposite sides of the upper end 266 of the folded web to grip and support the web therebetween, with rotation of the supporting belts 432 and 434 advancing the web. The supporting belts 432 and 434 are supported and advanced by a plurality of rollers 430 which extend the length of the apparatus and are channeled, with the supporting belts 432 and 434 extending tautly around the supporting rollers 430, residing within the channels 431 thereof to prevent the supporting belts 432 and 434 from slipping off the rollers 430. The thickness of the supporting belts 432 and 434 is greater than the depth of the supporting roller channels 431 so that the supporting belts contact the web 204 when pressed together on opposite sides thereof, rather than the rollers themselves doing the contacting. One of the rollers 430 of both the left side supporting belt 432 and the right side supporting belt 434 is a powered roller, driven by a motor to advance the respective belt.

After being folded, the web 204 is then advanced by the supporting belts 432 and 434 to perforating station 248, which in accordance with the preferred embodiment is shown in FIGS. 12 and 13. Thereat, the folded web 204 passes between perforating roller 250 and backing roller 252, with the backing roller 252 biased into abutment against the perforating roller 250 so that the perforating roller 250 presses against the web with sufficient pressure to penetrate both sidewalls and thereby form a continuous line of perforation. With reference to FIG. 12, the backing roller 252 is mounted on an arm 445 which is supported for pivotal movement about pivot shaft 439. The backing roller is biased into abutment with the perforating roller 250 by spring 429. To synchronize rotation of the rotary perforating blade 250 with the intermittent web advancements in this embodiment, and thereby help to assure a continual, horizontal line of perforation 254, timing belts 435 and 437 are employed. Supporting belt 432 extends tautly around timing shaft 436 with the supporting belt 432 received in an upper channel 431 and the timing belt 435 received in a lower channel 431. The timing belt 435 also extends around backing roller pivot shaft 439. Hence, as best seen in FIG. 13, as the supporting belt 432 is advanced, it drives timing shaft 436 which, in turn, drives the backing roller pivot shaft 439.

To maintain powered rotation of the backing roller 252 as it pivots about backing roller pivot shaft 439, the backing roller pivot shaft 439 and backing roller shaft 441 are connected by a belt 443 which extends around the lower ends thereof. Thus, as the backing roller pivot shaft 439 rotates, the backing roller shaft 441 is rotated therewith to rotate the backing roller 252. Accordingly, the backing roller 252 rotates forward and backward an amount directly proportional to the forward and backward movement of supporting belt 432, regardless of the rotational position of the backing roller shaft 441 about the backing roller pivot shaft 439.

With continued reference to FIG. 13, timing belt 437 is employed to synchronize rotation of the perforating blade 250 with advancement of supporting belt 434. Both the supporting belt 434 and the timing belt 437 extend tautly around timing shaft 438, with the supporting belt 434 received in an upper channel 431 and the timing belt received in a lower channel 431. Hence, as the supporting belt 434 is advanced, it drives timing shaft 438 which drives timing belt 437 to rotate perforating blade shaft 451. Accordingly, the perforating roller 250 rotates forward and backward an amount directly proportional to the forward and backward movement of supporting belt 434. With the aforementioned arrangement, the speed of the peripheral cutting edge of the perforating roller 252 is maintained substantially equal to the speed of the web.

The height of the perforating roller 250 and the backing roller 252 are adjustable to accommodate different pouch sizes and configurations by adjusting the vertical position of the arm 445 along backing roller pivot shaft 439. Hence, a horizontal line of perforation 254 is formed in the sidewalls which extends between the folded lower end 232 and the male and female profiles 218 and 220 of the closure strip 208.

Since the closure strip 208 was attached to the plastic web 204 off-center, upon folding of the web 204 along the centerline 131, the closure strip 208 is now spaced above the folded lower end 232 of the plastic web 204. At this stage, only the male closure component flange 214 is attached to the web 204. When the web 204 was folded in half, this brought the sidewall 236 up against the planar side 224 of the female component 212 of the closure strip 208. Hence, after passing between the perforating roller 250 and backing roller of FIGS. 12 and 13 to form a horizontal line of perforation 254, the next stage of the pouch forming operation is to now seal the female closure component 212 to sidewall 236, so that the opposite male and female components 210 and 212 of the closure strip 208 are affixed to their respective opposite sidewalls 234 and 236.

To attach the flange 216 of the female closure component 212 to its respective sidewall 236, the web 204 is advanced by the supporting belts 432 and 434 to closure strip sealing station 255 at which a second horizontally extending heated sealing bar 256 is employed to effect the seal. The closure strip sealing station 255 is shown in plan view at the left side of FIG. 10, and in end view in FIG. 11.

The second heated sealing bar 256 and non-heated backing bar 257 extend horizontally and are intermittently pressed together on opposite sides of the folded web at the location of the closure strip 208 during the intervals at which the web 204 is at rest between its intermittent advancements. The second heated sealing bar 256 applies heat and pressure to the sidewall 236, with the pressure forcing the sidewall 236 against the planar side 224 of the female component 212 of the closure strip 208, and the heat being applied for a predetermined interval sufficient to seal the planar side 224 of the female component 212 of the closure strip 208 to its respective sidewall 236.

With reference to FIG. 10, respective hydraulic or pneumatic cylinders 440 and 442 are employed to force the second heated sealing bar 256 and backing bar 257 together. The second heated sealing bar 256 and backing bar 257 are supported for sliding translation, toward and away from one another, on support shafts 444. The actuation of the cylinders 440 and 442 is synchronized with the intermittent advancements of the web 204 such that the cylinders 440 and 442 are actuated to move the second heated sealing bar 256 and backing bar 257 together during the interval between successive web advancements during which period the web 204 is stationary at the closure strip seal station 255. The cylinders 400 and 402 then retract the second heated sealing bar 256 and backing bar 257 immediately prior to, and during, web advancements to allow uninhibited advancement of the web 204.

In order to allow for longitudinal repositioning of the second heated sealing bar 256 and backing bar 257 to accommodate different pouch widths, the entire closure strip seal station 255 is mounted for sliding translation on longitudinally extending support shafts 446. Hence, with reference to FIG. 10, the closure strip seal station 255 can be slid on the support shafts 446 to the right or left of the position shown and secured at a selective position. The vertical position of the second heated sealing bar 236 is also adjustable to compensate for different pouch lengths and different pouch configurations, in which the closure strip 208 may be at different vertical elevations. The second heated sealing bar is preferably heated by providing a cylindrical passage therein which receives an electrical resistance heating element.

At this stage, the web 204 exiting the closure strip seal station 255 is partially formed into a pouch, with the plastic web 204 folded over to define opposing sidewalls 234 and 236, a lower folded end 232, and upper sidewall edges 246 and 244. Also, the male and female closure components 210 and 212 are attached to their respective sidewalls 234 and 236, spaced slightly from the lower folded end 232, and interconnected with one another. The partially formed pouch is supported by the supporting belts 432 and 434 at its upper edges 244 and 246 and depends downward therefrom in an "inverted" position with the closure strip 208 being near the lower end and, as discussed above, the partially formed pouch remains in this inverted position throughout forming, filling and sealing thereof.

With reference to FIGS. **8*a* and 10, in accordance with the preferred embodiment of the invention, the partially formed pouch is next transported by the supporting belts 432 and 434, in the aforementioned manner, to peelable seal forming station 260. Thereat, the pair of heated, horizontally extending peelable seal forming bars 262 positioned on opposite sides of the web 204 at the vertical height of the peelable sealing strips 226 and 228 are pressed together on opposite sides of the folded web, to seal the peelable sealing strips 226 and 228** together.

As above with regard to the closure strip seal station 255, hydraulic or pneumatic cylinders 448 and 450 are employed to force the two peelable seal forming bars 262 together. The peelable seal forming bars 262 are supported for sliding translation, toward and away from one another, on support shafts 452. The actuation of the cylinders 448 and 450 is synchronized with the intermittent advancements of the web 204 such that the cylinders 448 and 450 are actuated to move the peelable seal forming bars 262 together during the interval between successive web advancements in which the web 204 is stationary at the peelable seal forming station 260. The cylinders 448 and 450 then retract the peelable seal forming bars 262 away from each other prior to, and during, web advancements to allow uninhibited advancement of the web 204.

The intermittent pressing together of the peelable seal forming bars 262 applies heat and pressure to the peelable sealing strips 226 and 228 sufficient to adhere the strips 226 and 228 together. As discussed above, the material selected for the peelable sealing strips 226 and 228 is such that the adhering peelable sealing strips 226 and 228 form a hermetic peelable seal 264 which is easily separable when pulled apart manually, but will not separate under the forces normally associated with shipping and handling.

In the preferred embodiment of the apparatus 400, the peelable seal forming bars 262 comprise metal bars having thin rubber leading ends of approximately ¾ to 1 inch thickness, which are pressed together on opposite sides of the folded web 204. The leading end of the seal forming bars preferably have a flat bottom with a sawtooth-shaped top. This saw-toothed peelable seal profile allows for easier separation of the peelable seal as compared with conventional, rectangular sealing.

The peelable seal forming bars 262 should extend longitudinally over a length greater than the length of the intermittent advancements of the plastic web 204 to assure that the entire length of the plastic web has a hermetic peelable seal formed thereacross, spaced slightly above the male and female closure component profiles 218 and 220 which also extend along the entire length of the plastic web 204.

As discussed above with regard to the closure strip seal station 255, the peelable seal forming station 260 is mounted on the support shafts 446 for slidable translation as a complete unit to any desired longitudinal position along the length of support shafts 446 to accommodate the formation of different pouch widths. Also, the vertical height of the horizontally extending peelable seal forming bars 262 is adjustable to accommodate the production of different pouch lengths and different pouch configurations.

As mentioned briefly above, in an alternative embodiment the peelable seal 264 and lines of perforation 254 are formed generally simultaneously and at a common peelable seal and perforating station 400. This allows for reduction in the length of the production line by two-pouch-widths, by effectively reducing the required number of stations by one station. Apparatus suitable for employment at this alternative combined peelable seal and perforating station 400 is shown in FIGS. 20–22.

A peelable seal forming mechanism 402 is situated above a perforating mechanism 404 whereby, at the same station 400 and at generally the same time, a peelable seal 264 is formed across the pouches at a vertical height above the interengaged closure strip components 218 and 220, and a line of perforation 254 is formed across the pouches at a vertical height below the interengaged closure strip components 218 and 220.

With reference to FIG. 20, the peelable seal forming mechanism 402 comprises heated peelable seal forming bars 406, which press together on opposite sides of the folded web at a height corresponding to the position of the peelable sealing strips 226 and 228. Sufficient heat and pressure are applied for a period sufficient to bond the peelable sealing strips 226 and 228 together to form peelable seal 264. The construction and operation of the peelable seal forming bars 406 are the same as those employed at peelable seal forming station 260 of the alternative embodiment, and therefore their construction and operation will not be reiterated here for conciseness.

Situated beneath these peelable seal forming bars 406 is the perforation forming mechanism 404. The alternative perforation forming mechanism 404 differs substantially from the mechanism of the rotary blade perforating station 248 discussed above. In accordance with this alternative perforation forming mechanism 404, a first securing member 410 and second securing member 412 are brought together on opposite sides of the partially formed pouches at a height corresponding to the desired location of the line of perforation 254. The securing members 410 and 412 secure the region of the pouch to be perforated in a rigid, substantially stationary position as a perforating blade 414 impacts the pouch to form the desired line of perforation 254.

The first securing member 410 includes a blade receiving slot 416 which extends at least partially into the first securing member 410 from its leading end 418, although the blade receiving slot 416 may extend completely through the first securing member 410. The depth of the blade receiving slot 416 is made sufficient to accommodate the perforating blade 414 during perforation, as will be explained below.

The second securing member 412 also includes a slot 420 within which the perforating blade 414 resides. The perforating blade 414 is connected to the second securing member 412 for reciprocal movement. A perforating blade support member 432 is integral with and supports the perforating blade 414. Hence, the perforating blade 414 and its support member 432 integral therewith are moveable between a retracted position (as shown in FIGS. 20 and 21) in which the perforating blade 414 does not extend beyond the leading end 422 of the second securing member 412, and a perforating position in which the perforating blade 414 extends beyond the leading end 422 of the second securing member 412 to perforate the pouches.

That is, with reference to FIGS. 20 and 21, when in its retracted position the leading end 424 of the perforating blade 414 resides within slot 420. When the perforating blade support member 432 is slid forward with respect to the second securing member 412, to move the perforating blade to its perforating position, the leading end 424 of the perforating blade is received at least partially within the blade receiving slot 416 of the first securing member 410. With the first and second securing members 410 and 412 brought together on either side of the pouch to secure that portion of the pouch in a stationary position, the pouch is pierced or perforated by the perforating blade 414 as the blade moves to its perforating position. The perforating blade 414 is elongated and includes linearly spaced teeth 415 which perforate the pouch upon impact to form a plurality of linearly aligned, generally equally spaced perforations in the pouch. Following movement to its extended position, the perforating blade 414 is rapidly withdrawn to its retracted position to allow subsequent advancement of the perforated pouch out of the station 400 and advancement of another pouch into the station 400. Only portions of the leading end 415 of the perforating blade 414 penetrate into the walls of the pouch to effect formation of the line of perforation.

To effect the desired movement of the perforating blade 414 between its retracted and perforating positions, the perforating blade support member 432 is biased with respect to the second securing member 412, to the retracted blade position, by springs 430. In the preferred embodiment, the second securing member 412 is moved to its securing position by actuating means integral with the perforating blade support member 432. The actuating means exerts a force on the perforating blade supporting member 432 to move the perforating blade supporting member 432 in the direction of the pouch and in the direction of the first securing member 410. The force of the spring 430 is sufficient that the second securing member 412 remains spaced from the perforating blade support member 432 as the perforating support member 432 and second securing member 412 slide together in the direction of the first securing member 410.

Upon abutment of the second securing member 412 with the first securing member 410, the force exerted by the actuating means on the blade supporting member 432 in the direction of the pouch is sufficient to overcome the force of the springs 430, whereby the blade supporting member 432 moves into abutment with the second supporting member 412, with the perforating blade thus moving to its perforating position. That is, initially the blade supporting member 432 and second securing member 412 slide together toward the pouch, with their spaced relation being maintained by the springs 430. However, following abutment of the second securing member 410 with the first securing member 412, further forcing of the blade supporting member 432 in the direction of the first securing member 410 effects sliding movement of the blade supporting member 432 into abutment with the second securing member 412, with the perforating blade 414 thus being moved to extend beyond the leading end 422 of the second securing member 412. The perforating blade 414 thus pierces the pouch at linearly spaced locations, with its leading end 424 being received in slot 416 of the first securing member. Accordingly, the first and second securing members 410 and 412 are brought together about the pouch to secure the portion of the pouch to be perforated in a stationary position. While the first and second securing members 410 and 412 remain pressed together to secure the pouch, the perforating blade 414 then moves to its perforating position. Thereafter, while the first and second securing members 410 and 412 remain together about the pouch, the actuating means moves the blade supporting member 432 back away from the pouch, whereby the blade 414 moves back toward its retracted position, with the securing members 410 and 412 still remaining together about the pouch. That is, upon initial retraction of the blade supporting member 432, the springs 430 continue to hold the second securing member 412 against the first securing member 410. Only upon the perforating blade 414 reaching its fully retracted position again is the second securing member 412 moved away from the first securing member 410. Hence, at all times that the perforating blade 414 is in contact with the pouch, the securing members 410 and 412 are pressed together about the portion of the pouch being perforated to secure that portion of the pouch in a stationary position during perforating.

The actuating means for effecting movement of the peelable seal mechanism 402 is independent of the actuating means for effecting movement of the perforation mechanism 404. However, in the preferred embodiment for practicing the invention, the actuating mechanisms of the peelable seal and perforation mechanisms 402 and 404 are synchronized. When the advancing web of partially formed pouches comes to rest during the interval between one of its intermittent advances, the peelable seal forming bars 406 are first moved together into engagement with the pouch to initiate formation of the peelable seal 254. Immediately thereafter, with the peelable seal forming bars 406 still together, the perforation mechanism 404 is actuated. The securing members 410 and 412 are brought together and the perforating blade 414 is extended and retracted to form the line of perforation 254. Thereafter, the securing members 410 and 412 are retracted away from the pouch. Finally, the peelable seal forming bars 406 are also retracted away from the pouch, and the web of partially formed pouches is again advanced to bring another portion of the partially formed pouches into the combined peelable seal and perforating station 400. Hence, it is preferred that the cycle time of the perforation mechanism 404 be shorter than the cycle time for formation of the peelable seal, so that no additional time is necessary to form the line of perforation 254, in excess of that required for formation of the peelable seal 264. The perforation mechanism 404 of the present invention provides the desired rapid cycling time to accomplish this.

With reference to the exploded view of FIG. 22, the perforating blade 414 is mounted to the blade support member 432 by securing the blade 414 between slat 440 and the lip 442 of the support member 432. This provides support to keep the blade 414 straight during perforating operations and allows for easy removability of the blade 414 to change blades after wear or damage to the blade.

Referring now to FIG. 20, in the preferred embodiment of the invention, heat shields 444 in the form of metal slats are positioned between the heated peelable seal forming bars 406 and the perforation mechanism 404. The heat shields 444 prevent the perforating blade 414 and securing members 410 and 412 from being heated, which heating may otherwise cause melting and sticking of the pouch plastic with these perforation mechanism components.

The securing of the partially formed pouch in a taut, stationary position with the securing members 410 and 412 while impacting the pouch with the perforating blade 414 has been found to be effective for perforating the flanges 214 and 216 of the closure components, as well as the sidewalls 234 and 236 of the pouch. Hence, with the perforating mechanism 404 of the present invention it is not necessary to design the pouch so that either the male or female closure member flanges 214 or 216 terminate short of the desired location for the line of perforation.

With reference now to FIG. 8*a* and the right side of FIG. 10, following formation of the peelable seal and line of perforation, whether formed by the preferred or any alternative embodiments, the folded web 204 is then advanced to the closure strip crushing and hole punching station 268 at which four equally-spaced, heated crushing bars 270*a*, 270*b* 270*c*, and 270*d* seal the male and female profiles 218 and 220 of the closure strip 208 together at one-pouch-width intervals along the length of the web 204. As discussed above with reference to the method for carrying out the invention, four closure strip sealing means are employed in conjunction with double bag width web advancements so that the closure strip 208 is sealed and then resealed at the same one bag width spaced locations.

While the web 204 is at rest at the closure strip crushing and hole punching station 268, between its intermittent advancements therethrough, hole punch devices 282 punch holes through the sidewalls 234 and 236. In the illustrated embodiment two hole punch devices 282 are employed, with one positioned midway between the second and third heated sealing bars 270*b* and 270*c*, and the other positioned midway between the third and fourth heated sealing bars 270*c* and 270*d* (see FIG. 8*a*) With this arrangement, and the web 204 being advanced two pouch widths upon each intermittent advancement thereof, each of the lengths of the folded web 204 has a single hole punched through both sidewalls 234 and 236 approximately midway between adjacent side seals 278.

A hole punch device 282 suitable for carrying out the present invention is illustrated in side view in FIG. 16. Hydraulic or pneumatic cylinder 460 has two shafts 462 and 464 which move outwardly away from one another to the position shown in FIG. 16 when an actuating medium enters through supply piping 46. The shafts 462 and 464 move toward one another when an actuating medium enters through inlet piping 468.

As seen in FIG. 14, punch housing 470 is mounted to shaft 462, and backing housing 472 is mounted to shaft 464. Hence, during web advancements the shafts 462 and 464 are moved outwardly separate the housings 470 and 472 to allow unimpeded passage of the web 204 therebetween. When the web 204 is at rest between its intermittent advancements, the shafts 462 and 464 are moved together, the housings 470 and 472 are brought together on opposite sides of the folded web 204.

The punch housing 270 also includes a pneumatic or hydraulic punch cylinder 474 which reciprocates punch 476 to the retracted position shown in FIG. 14 when actuating fluid enters the punch cylinder 474 through inlet piping 478, and moves the punch 476 very rapidly to an extended position when actuating fluid enters the cylinder through inlet piping 480. The backing housing 472 includes an aperture 482 proportioned to receive the punch 476.

Hence, when the web 204 is at rest at the closure strip crushing and hole punching station 268, cylinder 460 is actuated to move the punch housing 470 and backing housing 472 together, into abutment with one another on opposite sides of the folded web. Immediately thereafter, cylinder 474 is actuated to move the punch 476 rapidly to its extended position, whereby the punch 476 is forced through the sidewalls and is received in the aperture 482 of backing housing 472. The punch cylinder 474 is thereafter actuated again to retract the punch 476, and cylinder 460 is actuated to move the housings 470 and 472 back to their extended positions for subsequent web advancement.

The hole punch device 282, like the other components of the apparatus 400, is slidably mounted on support shafts 446 to allow variation of the longitudinal position of the hole punch device 282 to accommodate production of different pouch widths. The vertical height of the hole punch device 282 is also variable to accommodate different pouch lengths.

After exiting the closure strip sealing and hole punching station 268, the web 204 is transported to the side seal forming station 288. Thereat, the pair of vertically oriented side sealing bars 290*a* and 290*b* intermittently apply heat and pressure to longitudinally spaced, vertical lengths of the web 204 to form side seals 278 which divide the web longitudinally into separate, individual pouches. The side sealing bars 290 seal the opposite sidewalls 234 and 236 together from the folded lower end 232 terminating near the upper edges 244 and 246 of the sidewalls 236 and 234. The thin gap of unbonded sidewall provided at the upper end of the side seals 278 is provided to facilitate opening of the pouches for filling, as discussed above.

As with the second heated sealing bar 256 and backing bar 257, and the peelable seal forming bars 262, the side sealing bars 290 are actuated by hydraulic or pneumatic cylinders which press the side sealing bars 290 together on opposite sides of the folded web 204 during the interval at which the web 204 is at rest between its intermittent advancements. The heat and pressure applied is sufficient to heat narrow vertical sections of the sidewalls 234 and 236 such that the sidewalls securely bond to one another under the applied pressure.

The side sealing bars 290 include two narrow, vertically extending slits therein. At the end of the formation of the side seals 290, the pair of reciprocating cutting blades 294 are then moved rapidly through the pair of slits and into contact with the web 204 at the location of the formed side seals 278. The blades 294 form cuts 296 which extend from the lower, folded end 232 of the web 204 terminating near the upper, open end 266 of the partially formed pouches.

Hence, while the web 204 is at rest between intermittent advancements, the section of the web at the side seal forming station 288 has vertically extending side seals 278 formed with vertically extending slits 296 extending along a substantial portion of the seals 278.

The forming of the web 204 into pouches is substantially completed at this stage, with the web 204 now formed into a plurality of pockets 292 which are defined laterally by the side seals 278, and vertically by the folded bottom 232 and open, upper end 266, with the partially formed pouches remaining attached to one another by a thin section of web 204 at their upper ends.

The substantially formed pouches are advanced during the next intermittent advancement to a filling station 300 at which articles are loaded by gravity feed through the open upper end 266 of the substantially formed pouches into the pockets 292 which have been formed.

Immediately prior to entering the filling station 300, the supporting belts 432 and 434 terminate and the web is thereafter supported by a second set of belts (not shown) which press together on opposite sides of the substantially formed pouches at a vertical height beneath the peelable seal 264. Thus, there is no longer a belt extending along the upper end 266 of the substantially formed pouches. Thus provides the unobstructed access to the upper end 266 of the substantially formed pouches which is required for the filling and final cutting operations.

At the filling station 300, two pairs of fingers 304*a* and 304*b*, spaced a pouch width apart, extend partway into the pockets 292, extending between the sidewalls 234 and 236. The finger pairs 304*a* and 304*b* extend only a small distance below the upper edges 244 and 246 of the sidewalls, such that they do not extend as far down as the side seals 278. Hence, as the web 204 is advanced, the upper ends of the sidewalls 234 and 236 slide on opposite sides of the fingers 304, with the fingers therebetween. Since the upper ends of the sidewalls are not bonded together, the web 204 can slide freely past the fingers 304 without the web 204 interfering with the fingers.

The finger pairs 304*a* and 304*b* are positioned longitudinally along the apparatus 400 such that when the web 204 comes to rest between its intermittent advancements, the adjacent finger pairs 304*a* and 304*b* are positioned midway between adjacent side seals 278. Thus, as the leading pair of separating fingers 304*a* are at approximately the middle of one pocket 292, the trailing pair of separating fingers 304*b* are positioned at approximately the middle of another adjacent pocket 292. Hence, when the finger pairs 304*a* and 304*b* are intermittently pulled in opposite directions by hydraulic or pneumatic means, wide filling openings 302 are provided at the upper ends 266 of two adjacent substantially formed pouches. This allows articles to be loaded simultaneously into two adjacent pockets 292 through the two filling openings created. The separating of the upper ends 266 of the substantially formed pouches may result in portions of the web 204 backing up slightly. Hence, a suitable take-up apparatus may be employed to take up any slack in the belts 432 and 434 caused by the backing up of the web.

After the articles have been loaded into the pockets 292 through the openings 302, and still during the interval at which the web 204 is at rest between successive pouch advancements, the separating fingers 304 are then brought back together, whereafter the web is then advanced again to bring another pair of empty pockets 292 into registration with the separating fingers 304. This reciprocating action of the separating fingers 304 is continually repeated with the separating fingers 304 intermittently separated between pouch advancements to allow pouch filling, and then brought together during pouch advancements.

During filling of the pocket 292, the peelable seal 264 serves as a barrier which keeps the articles from contacting the closure members 210 and 212. The peelable seal 264 serves to prevent the articles from interfering with proper operation of the closure strip 208 during transport and storage of the pouches as well as during filling. Upon exiting the filling station 300, the pockets 292 are filled with articles and remain in an "inverted" position, with the open end 266 being at the top and the folded end 232 being at the bottom. The web 204 remains supported by the second set of belts near its lower end.

To completely seal the articles within the pockets 292, the web 204 is transported to an end closure station 310 which forms upper seals 311 horizontally at the upper, unbonded ends 244 and 246 of the pouches 292. Horizontally oriented heated sealing bars 312 are intermittently pressed together about opposite sides of the upper ends 244 and 246 of the sidewalls 234 and 236 to apply sufficient heat and pressure to seal the sidewalls together at their upper end.

The horizontally extending heated sealing bars 312 are made at least two pouches widths in length to correspond with the double pouch width web advancements. Hence, the two adjacent pockets 292 which have just been filled at the filling station 300 can be sealed simultaneously during the interval between successive web advancements. The horizontal heated sealing bars 312 are made wide enough so that the seal formed extends at least from the upper edges 244 and 246 of the sidewalls 234 and 236 down to the upper ends of the side seals 278. This assures that the pouch is hermetically sealed about its entire periphery. As discussed above with regard to other embodiments, gas flushing techniques may be employed during the filling and sealing stages.

Also at the end closure station 310, the narrow portion 314 of web 304 still interconnecting the pouches near their upper edges 244 and 246 is cut by separating blades 322 to separate the formed, filled and sealed pouches 320 from the remainder of the web 304. As with the side sealing bars 290, the horizontal heated sealing bars 312 at the end closure station 310 include two narrow, vertically extending slits therein. The slits are spaced one pouch width apart and are provided in the sealing bars 312 at the location at which the side seals 278 come to rest. At the end of the formation of the upper seals 311, the pair of reciprocating separating blades 322 are then moved rapidly through the pair of slits and into contact with the web 304 at the location of the side seals, thereby cutting the narrow section of web which remains attaching the finished pouches 276 to the remainder of the web 204. During the cutting, the pouches 276 remain supported by the second set of supporting belts which support the pouches 276 near their lower ends, so as not to interfere with the cutting at the upper ends 266 of the pouches 276.

The pouches 276 remain supported by the second set of supporting belts until the next subsequent double-pouch-width web advancement, whereupon the completed pouches 276 exit the apparatus. Thus, sealed pouches 276 exit the apparatus 400 in pairs, and upside-down, with articles completely hermetically sealed therein.

Alternatively, as mentioned briefly above, pouch separating apparatus 500 may be employed immediately after the end closure station 310 of the apparatus 400 to effect the final separation of the formed, filled, and sealed pouches 276, rather than blades 322. The pouch separating apparatus 500 of the present invention separates the formed pouches 276 one from the next, and conveys the separated pouches one at a time in a horizontal position for packaging in a carton or the like.

The preferred embodiment of the pouch separating apparatus 500 is illustrated in FIGS. 23–27. As discussed above, immediately prior to entering the filling station 300, the first supporting belts 432 and 434 terminate and the web is thereafter supported by a second set of belts (not shown in FIGS. 1–22) which press together on opposite sides of the substantially formed pouches at a vertical height beneath the peelable seal 264. Hence, after filling and formation of the end closure, the pouches 276 exit the end closure station 310 supported by a second set of belts which are referred to by numerals 502 and 504 in FIGS. 23–27. The second set of supporting belts 502 and 504 press together on opposite sides of the pouches 276 to support and convey the pouches 276 out of the end closure station 310.

At a location spaced from the end closure station 310 the second set of supporting belts 502 and 504 terminate, thereby releasing the formed pouches 276. Spaced more than one pouch width, but less than two pouch widths, from the terminal end 505 of the second set of supporting belts 502 and 504, a third set of supporting belts 506 and 508 begins. Thus, at the terminal end 505 of the second set of supporting belts 502 and 504, one of the formed pouches (the trailing pouch) remains engaged by the second set of supporting belts 502 and 504, while the pouch immediately ahead of this pouch (the leading pouch) is engaged by the third supporting belts 506 and 508. Upon initial engagement of the leading pouch by the third supporting belts 506 and 508, there remains a small narrow portion 314 of web 304 still interconnecting the leading and trailing pouches near their upper edges 244 and 246.

The rate of advancement of the third supporting belts 506 and 508 is made greater than the rate of advancement of the second set of supporting belts 502 and 504 so that the leading pouch engaged by the third supporting belts 506 and 508 is pulled away from the trailing pouch engaged by the slower moving second set of supporting belts 502 and 504. By making the rate of advancement of the third supporting belts 506 and 508 sufficiently greater than the rate of advancement of the second set of supporting belts 502 and 504, the leading pouch is pulled sufficiently away from the trailing pouch so as to tear the small narrow portion 314 of web 304 still interconnecting the leading and trailing pouches near their upper edges 244 and 246, thus separating the pouches.

Accordingly, as the newly formed, filled and sealed pouches 276, which still have a small narrow portion 314 remaining interconnecting each of the adjacent pouches, reach the terminal end 505 of the second set of supporting belts 502 and 504, the pouches 276 are separated from one another by the force of the third supporting belts 506 and 508 pulling the leading pouch from the remaining interconnected pouches. The separated pouches supported by the third support belts 506 and 508 are then advanced by the third support belts 506 and 508 in spaced relation from one another.

If the second and third sets of belts are set to grip the pouches 276 tightly, it may be necessary to space the beginning of the third set of belts 506 and 508 greater than one pouch width away from the terminal end 505 of the second set of supporting belts 502 and 504 in order to prevent distortion of the pouches. That is, with the second and third sets of belts spaced less than one pouch width apart and both gripping the pouches 276 tightly, a pouch may be gripped by both the first and second set of belt simultaneously. With the third set of supporting belts advancing faster than the second set of supporting belts, the pouch may stretch and become distorted permanently. Accordingly, by spacing the beginning of the third set of supporting belts 506 and 508 more than one pouch width from the terminal end 505 of the second set of supporting belts 502 and 504, the possibility of a single pouch 276 being pulled by both sets of belts simultaneously is eliminated.

It is also desirable that the spacing between the terminal end 505 of the second set of supporting belts 502 and 504 and the beginning of the third set of supporting belts 506 and 508 be less than two pouch widths, to assure that each of the narrow portions 314 interconnecting the adjacent pouches 276 are severed. The less than two pouch width spacing is also desirable to assure proper feeding from the second set of belts 502 and 504 into the third set of belts 506 and 508.

It is preferred, however, to adjust the supporting belts so that they allow some amount of slippage of the pouches within the belts when the pouches are pulled upon. With such slippage allowance, the spacing between the terminal end 505 of the second set of supporting belts 502 and 504 and the beginning of the third set of supporting belts 506 and 508 can be made less than one pouch width without concern for pouch distortion of the pouches.

The separation of the pouches having been achieved, it is desirable to then orient the separated pouches horizontally on a conveyor for subsequent packaging or the like. A plow 510, which in the illustrated embodiment is in the form of a horizontal deflecting bar 512, moves the lower end 512 of the advancing pouches 276 laterally with respect to the upper end 514 of the pouches 276 while the pouches are engaged by the third support belts 506 and 508, as discussed further below.

The path of travel of the pouches 276 defined by the second set of supporting belts 506 and 508 is substantially linear down the center of the conveyor belt 518. The forward portion 526 of the third support belts 506 and 508 is also oriented substantially linearly down the center of the conveyor belt 518. The conveyor belt 518 extends linearly, centered with respect to the linear path of travel of the pouches 276 defined by the second set of supporting belts 502 and 504 and the forward portion 526 of the third set of supporting belts 506 and 508.

The third set of belts 506 and 508 thus pick up the pouches 276 with the forward portion 526 of the belts 506 and 508 advancing the pouches linearly down the center of the conveyor belt 518. As the pouches 276 are advanced forwardly by the third set of belts 506 and 508, the pouches are advanced to the rearward portion 528 of the belts 506 and 508 which angles away from the conveyor belt center (see FIG. 26). The pouches 276 then advance along the rearward portion 528 of the third set of belts at an angle with respect to the conveyor belt centerline. As best seen in FIGS. 23 and 27, the rearward portion 528 of the third set of belts 506 and 508 terminates at terminal end 516, near the side 524 of the conveyor belt 518.

The deflecting bar 512 is disposed in the rearward portion 528 of the third set of belts 506 and 508 and extends horizontally at a height which deflects the lower portion of the pouches 276 supported by the third set of belts as the pouches are advanced past the deflecting bar 512. (It should be noted that reference to the lower portion of the pouches as they are supported by the third set of belts actually refers to the top of the formed pouches since the pouches are supported by the third set of belts in inverted orientation.)

The deflecting bar 512 is disposed horizontally, and at a non-perpendicular angle with respect to the leading edges 520 of the advancing pouches, as well as with respect to the sides 522 and 524 of the conveyor belt 518. Accordingly, the leading ends 520 of the advancing pouches 276 slide or bear against the deflecting bar 512, with the angling of the bar 512 effecting pushing of the lower end of the pouches 276 upward and toward the side 522 of the conveyor 518. That is, the rearward portion 528 of the third set of supporting belts 506 and 508 moves the upper portion of the pouches 276 supported by the supporting belts 506 and 508 from the centerline of the conveyor belt 518 toward a first end 524 of the conveyor belt 518 while, simultaneously, the deflecting bar 512 moves the lower portion of the advancing pouches 276 toward the opposite side 522 of the conveyor belt 518.

As best seen in FIG. 26, the lower ends of the pouches 276 slide off of the deflecting bar 512 just prior to the upper ends of the pouches 276 reaching the terminal end 516 of the third set of supporting belts 506 and 508. The deflecting bar 512 is adjustable vertically to accommodate differently sized pouches.

As best seen in FIG. 24, the conveyor belt 518 extends at an angle from horizontal and is adjustable relative to the deflecting bar 512 and supporting belts 506 and 508 by pivoting about fixed end 530 of the conveyor belt. The pivotal end 532 of the conveyor belt 518 is adjusted to a position (dependent upon the pouch size and hence dependent upon the vertical height of the deflecting bar) so that a portion of the conveyor belt 518 lies situated immediately beneath the deflecting bar 512. Accordingly, as the lower ends of the pouches slide off of the deflecting bar 512, they slide onto the conveyor belt 518 while the upper ends of the pouches remain supportingly engaged by the third set of belts 506 and 508. Immediately following the sliding of the lower ends of each pouch off the deflecting bar 512 and onto the conveyor 518, the upper end of each of the pouches reaches the terminal end 516 of the third set of supporting belts 506 and 508, at which the upper ends of the pouches is released.

Thus, upon release of the upper end of a pouch 276 from the third set of supporting belts 506 and 508, the upper end of the pouch falls onto the conveyor belt 518 near end 524, with the lower end of the pouch supported on the conveyor 518 near end 522. By properly positioning the angle from horizontal of the conveyor belt 518, the height and angle of the deflecting bar 512, and the location of the terminal end 516 of the third set of supporting belts 506 and 508, it is possible to have the pouches 276 released onto the conveyor belt 518 with each pouch centered between the ends 522 and 524 of the conveyor belt 518 and oriented perpendicularly to the centerline of the conveyor belt, as shown in FIG. 26.

From the above discussion it is seen that the pouch separating apparatus 500 of the present invention provides means for separating interconnected pouches and positioning the separated pouches onto an advancing conveyor belt in a uniform and consistent manner.

With reference to FIGS. 23–27, various features of the pouch separating apparatus 500 will now be described in greater detail. A frame 536 extends on either side of the conveyor belt 518 and supports the remainder of the apparatus 530 above the conveyor belt 518. The frame 536 supports a support plate 538 generally horizontally above the conveyor belt 518. Supporting belt guide rollers 540 and 542 depend vertically from the support plate 538 for rotational movement about a vertical axis, and serve to guide and support respective belts 506 and 508 for continuous rotation about their respective rollers.

Continuous support belt 506 extends about a stationary bearing plate 546 over the forward portion 526 of the belt 506, and extends about a stationary bearing plate 548 over the rearward portion 528 of the belt 506. The stationary bearing plates 546 and 548 are supported by plate adjusting pins 550 which are integral with respective bearing plates 546 and 548 and spaced along the length of the plates. The adjusting pins 550 depend vertically from the support plate 538, being received and secured within respective apertures 552 of the support plate 538, which apertures 552 are arranged along the support plate 538 so as to define the desired path of travel of the support belt 506. With each of the support pins 550 secured in their respective apertures 552, the bearing plates 546 and 548 extend generally vertically beneath the support plate 538. Support belt 506 slides along and bears against the bearing plates 546 and 548 as the belt 506 is advanced.

Continuous support belt 508 extends about a spring biased bearing plate 556 over the forward portion 526 of the belt 508, and extends about spring biased bearing plate 558 over the rearward portion 528 of the belt 508. The spring biased bearing plates 556 and 558 are supported at the same height as the respective stationary bearing plates 546 and 548, and are biased in the direction of the stationary bearing plates 546 and 548 so that the belts 506 and 508 are pressed against one another by the bearing plates as they pass between the stationary bearing plates 546 and 548 and the spring biased bearing plates 556 and 558. Accordingly, a pouch 276 engaged by the third set of supporting belts 506 and 508 is supported by the supporting belts 506 and 508 by the force of the belts 506 and 508 pressing against one another on opposite sides of the pouch 276. Bearing plates 546 and 556, as well as bearing plates 548 and 558, press the belts 506 and 508 together as the belts 506 and 508 are advances, to support the pouches as they are advanced.

The spring biased bearing plates 556 and 558 are supported by brackets 560 and 562. Brackets 560 and 562 are supported by plate adjusting pins 564 and 566 which are integral with respective brackets 560 and 562 and spaced along the length of the plates 556 and 558. The adjusting pins 564 and 566 depend vertically from the support plate 538, being received and secured within respective apertures 554 of the support plate 538, which apertures 554 are arranged along the support plate 538 in a pattern corresponding to the desired path of travel of the support belt 508. With each of the support pins 564 and 566 secured in their respective apertures 554, the spring biased bearing plates 556 and 558 extend generally vertically beneath the support plate 538. Springs 568 extend between the brackets 560 and 562 and spring biased bearing plates 560 and 562 to bias the spring biased bearing plates 560 and 562 in the direction of the stationary bearing plates 546 and 548. The support belt 508 slides along and bears against the spring biased bearing plates 556 and 558 as the belt 508 is advanced. The spring biasing arrangement allows some degree of slippage of pouches 276 supported between the third set of support belts 506 and 508.

The belts 506 and 508 are advanced by a drive motor 570. Drive motor 570 is supported above the support plate 538, and the shaft 572 of the drive motor 570 is connected directly to first power roller 574 which also serves as a guide roller 542. Hence, first power roller 568 advances the belt 508. The same drive motor 570 also powers advancement of support belt 506. A gear 576 is mounted to the shaft 566 of the first power roller 568, which meshes with a gear 578 attached to the shaft 580 of the second power roller 582 to advance the support belt 508. Since the gear ratio between gears 576 and 578 is made 1:1, belt 506 advances at the same speed as belt 508.

The deflecting bar 512 is adjustable both angularly and vertically, as discussed above. The frame 236 supports a securing plate 584 from which the deflecting bar 512 depends via support rods 586 and 588. Support rod 586 is attached to the supporting plate 538 at aperture 590 for pivotal movement of the support rod 586 with respect to the supporting plate 538. Support rod 588 is received within arcuate slot 592 of the securing plate 584 for sliding movement of the deflecting plate 512 to the desired angular position. Accordingly, the deflecting plate 512 is adjustable angularly by sliding support rod 588 within arcuate slot 592 and then securing the rod 588 in the desired position within the slot 592. Both support rods 586 and 588 are also adjustable vertically and securable at a desired vertical height, dependent upon the size of the pouch 276 being run.

From the foregoing, it will be appreciated that the invention provides a novel pouch and method and apparatus for forming, filling and sealing the pouch. The invention is not limited to the embodiments described above or to any particular embodiments. The invention is more particularly pointed out in the following claims.

What is claimed is:

1. A method of forming, filling and sealing a hermetic pouch in an inverted orientation, said method comprising:

providing wall material for defining a pair of walls for the pouch;

orienting said wall material so that said walls are substantially vertical;

positioning first and second lengths of fastener strip material between said walls, said lengths of fastener strip material having complementary mechanically interengageable fastener members thereon;

forming a linear horizontal peelable seal above said fastener members;

sealing said lengths of fastener strip material to said walls, with each length of fastener strip material being joined to a respective one of said pair of walls;

forming a pair of substantially vertical seals joining said walls, so as to define a product-receiving pocket having a width determined by the distance between said vertical seals;

dispensing product downwardly into said product-receiving pocket after forming the linear horizontal peelable seal above said fastener members to fill said pocket to a predetermined level, said peelable seal being disposed between said pocket and said fastener members during said product dispensing to maintain isolation of the product from the fastener members during said dispensing of the product into the pouch;

forming a horizontal seal generally between said walls above said predetermined level to seal the product in the product-receiving pouch; and separating said pouch from said wall material.

2. A method in accordance with claim 1 wherein the step of forming a linear horizontal peelable seal is carried out simultaneously with the step of sealing said lengths of fastener strip material to said walls.

3. A method in accordance with claim 2 wherein the step of forming a linear horizontal peelable seal and the step of sealing said lengths of fastener strip material to said walls are carried out by a pair of horizontal sealing bars which are reciprocable inward and outward to apply heat and pressure to said walls and said fastener strip material.

4. A method in accordance with claim 3 further comprising the step of flushing the pouch with $N_2$ gas.

5. A method in accordance with claim 1 further comprising:

sealing together said lengths of fastener strip material beneath said fastener members, to form an additional seal between said lengths of fastener strip material; and providing one or more lines of weakness between said additional seal and said fastener members to facilitate removal of said additional seal from said pouch without removal of said fastener members from said pouch.

6. A method in accordance with claim 5 further comprising:

forming a hole through said pouch beneath said fastener members.

7. A method in accordance with claim 1 further comprising forming an additional seal between said walls beneath said first and second lengths of fastener strip material, and providing one or more lines of weakness between said additional seal and said lengths of fastener strip material.

8. A method in accordance with claim 7 further comprising providing a hole through said pouch beneath said fastener members.

9. Apparatus for forming, filling and sealing a hermetic pouch in an inverted orientation, said apparatus comprising:

means for supplying wall material for defining a pair of walls for the pouch;

means for orienting said wall material so that said walls are substantially vertical;

means for positioning first and second lengths of fastener strip material between said walls, said lengths of fastener material having complementary mechanically-interengageable fastener members thereon;

means for sealing said lengths of fastener strip material to said walls, with each length of fastener strip material being joined to a respective one of said pair of walls;

means for forming a peelable seal above said fastener strips;

means for forming a pair of substantially vertical seals joining said walls, so as to define a product-receiving pocket having a width determined by the distance between said vertical seals, said peelable seal being disposed between said product-receiving pocket and said fastener members to maintain isolation of the product from the fastener members;

means for dispensing product downward into said pocket after forming the peelable seal above said fastener strips to fill said pocket to a predetermined level, with said peelable seal acting as a barrier to contact of said product with said fastener members during filling of said pocket;

means for forming a generally horizontal seal between said walls above said predetermined level; and means for separating said pouch from said wall material.

10. Apparatus in accordance with claim 9 further comprising means for sealing together said lengths of fastener strip material beneath said fastener members, to form an additional seal between said lengths of fastener strip material, and means for providing one or more lines of weakness between said additional seal and said fastener members to facilitate removal of said additional seal from said pouch without removal of said fastener members from said pouch.

11. Apparatus in accordance with claim 10 further comprising means for forming a hole through said pouch beneath said fastener members.

12. Apparatus in accordance with claim 9 further comprising means for forming an additional seal between said walls beneath said first and second lengths of fastener strip material, and providing one or more lines of weakness between said additional seal and said lengths of fastener strip material.

13. Apparatus in accordance with claim 12 further comprising means for providing a hole through said pouch beneath said fastener members.

14. A method of forming, filling and sealing a hermetic pouch in an inverted orientation, said method comprising:

providing an elongated, longitudinally extending web of polymeric material having longitudinal edges and a longitudinally extending centerline midway between said longitudinal ends;

providing a closure strip having interengaged first and second complementary mechanically interengageable fastener components thereon, and having means for forming a linear horizontal peelable seal above said fastener members in a sealing area coextensive with said fastener components;

sealing said first fastener component longitudinally along the length of said sheet of polymeric material, spaced transversely from the centerline;

folding said web of polymeric material along said centerline to bring the longitudinal edges together to form first and second vertically oriented sidewalls integrally connected at a fold at the lower end of said web, the closure strip thereby being spaced vertically above the folded lower end and said second component of the closure strip thereby being brought into proximity with the second sidewall;

forming a longitudinally extending line of weakness in both said first and second sidewalls extending between said folded lower end and said fastener components by engaging said web with a rotary cutting blade having a notched peripheral cutting edge;

sealing said second fastener component longitudinally along the length of said second sidewall;

forming a linear horizontal peelable seal above said interengaged fastener components;

sealing said first and second fastener components together at predetermined longitudinal intervals corresponding to a predetermined pouch width;

forming a hole through said first and second sidewalls below the closure components and approximately midway between each of said closure component seals;

sealing said first sidewall to said second sidewall along the entire vertical length of said sidewalls at the longitudinal location of each of the closure component seals, so as to define a pocket having a width determined by the distance between said vertical seals;

separating said first sidewall and said second sidewall at the upper ends thereof to create a filling opening;

dispensing product downward into said pocket through said filling opening after forming the linear horizontal peelable seal above the fastener members to fill said pocket to a predetermined level with the peelable seal being disposed between the pocket and the fastener members during said product dispensing to maintain isolation of the product from the fastener members during said dispensing of the product into the pouch;

sealing said first sidewall to said second sidewall across the upper ends of the sidewalls to seal the product within the pocket and form a hermetic pouch; and separating said pouch from said web;

wherein said web is driven forward intermittently at a predetermined speed by a pair of timing belts which engage said web from opposite sides after folding of said web, and wherein said rotary cutting blade is driven for rotation by one of said timing belts so that said notched peripheral cutting edge has a speed equal to said predetermined speed of said web.

15. An apparatus for forming, filling and sealing a hermetic pouch in an inverted orientation from an elongated, longitudinally extending web of polymeric material having longitudinal edges and a longitudinally extending centerline midway between said longitudinal edges and a closure strip having interengaged first and second complementary mechanically interengageable fastener components thereon, and having means for forming a linear horizontal peelable seal above said fastener members in a sealing area coextensive with said fastener components, said apparatus comprising:

means for sealing said first fastener component longitudinally along the length of said web of polymeric material, spaced transversely from the centerline;

means for folding said web of polymeric material along said centerline to bring the longitudinal edges together to form first and second vertically oriented sidewalls integrally connected at the fold at the lower end thereof, the closure strip thereby being spaced vertically above the folded lower end and said second component of the closure strip thereby being brought into proximity with the second sidewall;

means for forming a longitudinally extending line of weakness in said first and second sidewalls extending between said folded lower end and said fastener components;

a pair of timing belts for driving said web forward intermittently at a predetermined speed, said timing belt engaging said web from opposite sides;

means for sealing said second fastener component longitudinally along the length of said second sidewall;

means for forming a linear horizontal peelable seal above said interengaged fastener components;

means for sealing said first and second fastener components together at predetermined longitudinal intervals corresponding to a predetermined pouch width;

means for forming a hole through said first and second sidewalls below the closure components and approximately midway between each of said closure component seals;

means for sealing said first sidewall to said second sidewall along the entire vertical length of said sidewalls at the longitudinal location of each of the closure component seals, so as to define a pocket having a width determined by the distance between said vertical seals;

means for separating said first sidewall and said second sidewall at their upper ends to create a filling opening;

means for dispensing product downward into said pocket through said filling opening after forming the linear horizontal peelable seal above the interengaged fastener components to fill said pocket to a predetermined level with the peelable seal being disposed between the pocket and the fastener members during said product dispensing to maintain isolation of the product from the fastener components during said dispensing of the product into the pouch;

means for sealing said first sidewall to said second sidewall across the upper ends of the sidewalls to seal the product within the pocket and form a hermetic pouch; and means for separating said pouch from said web; wherein said means for forming a longitudinally extending line of weakness in said first and second sidewalls comprises a rotary cutting blade having a notched peripheral cutting edge, and wherein said rotary cutting blade is driven for rotation by one of said timing belts so that said notched peripheral cutting edge has a speed equal to said predetermined speed of said web.

16. An apparatus in accordance with claim 15 wherein said means for sealing said first and second fastener components together at predetermined longitudinal intervals comprises a plurality of longitudinally spaced sealing means, and said means for forming a hole through said first and second sidewalls comprises a plurality of longitudinally spaced punching means, wherein each of said punching means is positioned longitudinally between two adjacent sealing means.

17. A method of forming, filling and sealing a hermetic pouch, said method comprising:

intermittently advancing an elongated, longitudinally extending web of polymeric material longitudinally approximately two predetermined pouch widths, the web having longitudinal edges and a centerline midway between said longitudinal edges;

intermittently advancing an elongated closure strip having interengaged first and second complementary mechanically interengageable fastener components thereon, each having a flange with means for forming a linear horizontal peelable seal above said fastener members in a sealing area coextensive with said fastener components;

bringing the closure strip adjacent the web of polymeric material as both are intermittently advanced, with the closure strip extending longitudinally;

applying heat and pressure to the flange of the first closure component during the intervals between successive web and closure strip advancements to adhere the first closure component to the first sidewall at a location spaced transversely from said centerline;

folding said web of polymeric material along said centerline and bringing the longitudinal edges together to form first and second vertically oriented sidewalls integrally connected at the folded lower end thereof, the closure strip thereby being spaced vertically above the folded lower end, and said second sidewall thereby being brought into proximity with said second component of the closure strip;

engaging the sidewalls with a rotary perforating blade during the periods of intermittent web and closure strip advancements to form a horizontal line of weakness in both said first and second sidewalls, the line of weakness extending horizontally between said folded lower end and said male and female profiles of the closure components;

applying heat and pressure to the second sidewall at the location of the flange of the second closure component during the intervals between said intermittent web and closure strip advancements to adhere the second closure component to the second sidewall;

applying heat and pressure to said first and said second sidewalls at the location of said closure strip sealing area during the intervals between intermittent web and closure strip advancements to form a horizontally extending peelable seal above said fastener components;

bonding together said first and second closure strip fastener components at predetermined, longitudinally spaced intervals corresponding to the predetermined width of the pouch;

punching holes through the first and second sidewalls, while the web and closure strip are at rest between their intermittent advancements, the holes being punched at a position below the closure strip fastener components, above the line of weakness, and approximately midway between adjacent, laterally spaced closure strip bondings;

applying heat and pressure to narrow, vertically extending sections of said first and second sidewalls at the longitudinally-spaced positions of the closure strip bondings, thereby sealing the sidewalls together thereat and forming side seals so as to create a product-receiving pocket having a width defined by the distance between adjacent vertical seals, said peelable seal being disposed between said product-receiving pocket and said fastener components to maintain isolation of the product from the fastener members;

cutting said first and second sidewalls vertically at approximately the center of said side seals, during the intervals between intermittent web and closure strip advancements, the cuts extending vertically from the folded lower end and terminating a small distance from the upper ends of the sidewalls;

separating the upper ends of the first and second sidewalls approximately midway between adjacent side seals to create a filling opening;

dispensing product downward into said filling opening to fill said pocket to a predetermined level after the formation of the peelable seal above the fastener components, with said peelable seal acting as a barrier to contact of said product with said fastener members during said product dispensing;

applying heat and pressure along narrow, horizontally extending sections of said sidewalls at a vertical position above said predetermined level to seal said sidewalls together thereat, a hermetic pouch thereby being formed with the product being hermetically sealed within the pocket thereof; and cutting the thin sidewall section remaining at the upper ends of the sidewalls at approximately the center of the side seals to separate said hermetic pouches from the remainder of the web.

18. A method for forming, filling and sealing a pouch having easy opening and resealing characteristics, the method comprising:

intermittently advancing an elongated, longitudinally extending web of polymeric material longitudinally approximately two predetermined pouch widths, the web having transverse ends and a centerline midway between said transverse ends;

intermittently advancing an elongated closure strip having interengaged first and second complementary mechanically interengageable fastener components thereon, each having a respective flange with means for forming a linear horizontal peelable seal above said fastener members in a sealing area coextensive with said fastener components;

bringing the closure strip adjacent the web of polymeric material as both are intermittently advanced, with the closure strip extending longitudinally;

applying heat and pressure to the flange of the first closure component during the intervals between successive web and closure strip advancements to adhere the first closure component to the web of polymeric material spaced transversely from said centerline;

folding said web of polymeric material along said centerline and bringing the transverse ends together to form first and second vertically oriented sidewalls integrally connected at the folded lower end thereof, the closure strip thereby being spaced vertically above the folded lower end, and said second sidewall thereby being brought into proximity with said second component of the closure strip;

applying heat and pressure to the second sidewall at the location of the flange of the second closure component during the intervals between said intermittent web and closure strip advancements to adhere the second closure component to the second sidewall;

applying heat and pressure to said first and said second sidewalls at the location of said closure strip sealing area during the intervals between intermittent web and closure strip advancements to form a horizontally extending peelable seal above said fastener components;

perforating the sidewalls by impacting the sidewalls with a perforating blade while securing the sidewalls in a stationary position, during the periods of intermittent web and closure strip advancements, to form a horizontal line of perforation in both said first and second sidewalls, the line of perforation extending horizontally between said folded lower end and said male and female profiles of the closure components;

applying heat and pressure to said first and second sidewalls along narrow, horizontally extending sections of said sidewalls to form a seal at approximately the vertical position of said line of perforation;

applying heat and pressure to narrow, vertically extending sections of said first and second sidewalls at longitudinally spaced intervals corresponding to the predetermined width of the pouch, thereby sealing the sidewalls together thereat and forming side seals so as to create a pocket having a width defined by the distance between adjacent vertical seals;

cutting said first and second sidewalls vertically at approximately the center of said side seals, during the intervals between intermittent web and closure strip advancements, the cuts extending vertically from the folded lower end and terminating a small distance from the upper ends of the sidewalls;

separating the upper ends of the first and second sidewalls approximately midway between adjacent side seals to create a filling opening;

dispensing product downward into said filling opening after forming the linear horizontal peelable seal above the fastener members to fill said pocket to a predetermined level with the peelable seal being disposed between the pocket and the fastener members during said product dispensing to maintain isolation of the product from the fastener members during said dispensing of the product into the pouch;

applying heat and pressure along narrow, horizontally extending sections of said sidewalls at a vertical position above said predetermined level to seal said sidewalls together thereat, a pouch thereby being formed with the product being sealed within the pocket thereof; and cutting the thin sidewall section remaining at the upper ends of the sidewalls at approximately the center of the side seals to separate said hermetic pouches from the remainder of said sidewall material.

19. A method in accordance with claim 18 wherein the respective flanges of the first and second complementary mechanically interengageable fastener components include a tacking flange portion on one side of the interengageable fastener components and a peelable seal forming flange portion on the other side thereof, with said first and second peelable seal flange portions being generally coterminous and said first tacking portion terminating prior to said second tacking portion to reduce the material through which said perforating blade must penetrate in forming said perforations and to reduce the amount of material available to flow into the perforations upon sealing thereat.

20. A method in accordance with claim 18 wherein the step of perforating the sidewalls, and the step of applying heat and pressure to the sidewalls at the location of said closure strip sealing area to form a horizontally extending peelable seal above said fastener components, are carried out generally simultaneously during one of said intervals between intermittent advancements.

21. A method in accordance with claim 18 wherein the step of perforating the sidewalls by impacting the sidewalls with a perforating blade while securing the sidewalls in a stationary position, comprises bringing said first and second sidewalls between opposing securing members and moving the securing members together on opposite sides of the sidewalls to secure the sidewalls in a stationary position, and rapidly advancing said perforating blade into contact with the first and second sidewalls and retracting said perforating blade away from said first and second sidewalls simultaneous with said securing by said securing members.

22. An apparatus for forming, filling and sealing a pouch with easy opening and resealing characteristics, comprising:

means for intermittently advancing an elongated, longitudinally extending web of polymeric material longitudinally approximately two predetermined pouch widths, the web having transverse ends and a centerline midway between said transverse ends;

means for intermittently advancing an elongated closure strip having interengaged first and second complementary mechanically interengageable fastener components thereon, each having a respective flange with means for forming a linear horizontal peelable seal above said fastener members in a sealing area coextensive with said fastener components;

means for bringing the closure strip adjacent the web of polymeric material as both are intermittently advanced, with the closure strip extending longitudinally;

means for applying heat and pressure to the flange of the first closure component during the intervals between successive web and closure strip advancements to adhere the first closure component to the web of polymeric material spaced transversely from said centerline;

means for folding said web of polymeric material along said centerline and bringing the transverse ends together to form first and second vertically oriented sidewalls integrally connected at the folded lower end thereof, the closure strip thereby being spaced vertically above the folded lower end, and said second sidewall thereby being brought into proximity with said second component of the closure strip;

means for applying heat and pressure to the second sidewall at the location of the flange of the second closure component during the intervals between said intermittent web and closure strip advancements to adhere the second closure component to the second sidewall;

means for applying heat and pressure to said first and said second sidewalls at the location of said closure strip sealing area during the intervals between intermittent web and closure strip advancements to form a horizontally extending peelable seal above said fastener components;

means for perforating the sidewalls by impacting the sidewalls with a perforating blade while securing the sidewalls in a stationary position, during the periods of intermittent web and closure strip advancements, to form a horizontal line of perforation in both said first and second sidewalls, the line of perforation extending horizontally between said folded lower end and said male and female profiles of the closure components;

means for applying heat and pressure to said first and second sidewalls along narrow, horizontally extending sections of said sidewalls to form a seal at approximately the vertical position of said line of perforation;

means for applying heat and pressure to narrow, vertically extending sections of said first and second sidewalls at longitudinally spaced intervals corresponding to the predetermined width of the pouch, thereby sealing the sidewalls together thereat and forming side seals so as to create a pocket having a width defined by the distance between adjacent vertical seals;

means for cutting said first and second sidewalls vertically at approximately the center of said side seals, during the intervals between intermittent web and closure strip advancements, the cuts extending vertically from the folded lower end and terminating a small distance from the upper ends of the sidewalls;

means for separating the upper ends of the first and second sidewalls approximately midway between adjacent side seals to create a filling opening;

means for dispensing product downward into said filling opening after forming the linear horizontal peelable seal above the fastener members to fill said pocket to a predetermined level with the peelable seal being disposed between the pocket and the fastener members during said product dispensing to maintain isolation of the product from the fastener members during said dispensing of the product into the pouch;

means for applying heat and pressure along narrow, horizontally extending sections of said sidewalls at a vertical position above said predetermined level to seal said sidewalls together thereat, a pouch thereby being formed with the product being sealed within the pocket thereof; and means for cutting the thin sidewall section remaining at the upper ends of the sidewalls at approximately the center of the side seals to separate said hermetic pouches from the remainder of said sidewall material.

23. An apparatus in accordance with claim 22 wherein said means for perforating the sidewalls by impacting the sidewalls with a perforating blade while securing the sidewalls in a stationary position comprises:

a frame;

opposing first and second securing members mounted to said frame for reciprocating movement between a securing position in which the securing members are brought together to exert and maintain a force on opposite sides of the sidewalls sufficient to secure the sidewalls in a substantially stationary position over at least the portion thereof in proximity with said securing members;

one of said first and said second securing members having an upper portion and a lower portion with a blade-accommodating slot therebetween;

a perforating blade mounted to said frame and disposed in said blade-accommodating slot for reciprocating movement between an extended position in which the blade is in contact with said first and second sidewalls to form said perforations, and a retracted position in which the blade is spaced from said first and second sidewalls.

24. An apparatus in accordance with claim 23 wherein the other of said first and second securing members has a blade-receiving slot for receiving the portion of the perforating blade passing through said sidewalls.

25. The method in accordance with claim 1 in which the lengths of fastener strip material have means for forming a linear horizontal peelable seal above said fastener members in a sealing area coextensive with said fastener members.

26. Apparatus in accordance with claim 9 in which the means for forming a peelable seal and the means for fastening the lengths of fastener strip material to the walls comprise means for forming the peelable seal am the location of the fastening of the lengths of fastener strip material to the walls.

27. Apparatus in accordance with claim 9 in which the means for forming a peelable seal and the means for fastening the lengths of fastener strip material to the walls comprise a single means for applying heat and pressure to seal the lengths of fastener strip material to one another and to their respective walls generally simultaneously.

* * * * *

UNITED STATES PATENT AND TRADEMARK OFFICE

CERTIFICATE OF CORRECTION

PATENT NO. : 5,519,982

DATED : May 28, 1996

INVENTOR(S) : Terrence W. HERBER et al.

It is certified that error appears in the above-indentified patent and that said Letters Patent is hereby corrected as shown below:

Column 40, line 57, change "am" to --at--.

Signed and Sealed this

Seventh Day of January, 1997

*Attest:*

*Attesting Officer*

BRUCE LEHMAN

*Commissioner of Patents and Trademarks*